US011554568B2

(12) United States Patent
Strong et al.

(10) Patent No.: US 11,554,568 B2
(45) **Date of Patent: *Jan. 17, 2023**

(54) MACHINE AND METHOD FOR FORMING A CONTAINER

(71) Applicant: WESTROCK SHARED SERVICES, LLC, Atlanta, GA (US)

(72) Inventors: Benjamin Strong, Covington, GA (US); Brian Lowe, Davenport, IA (US)

(73) Assignee: WestRock Shared Services, LLC, Atlanta, GA (US)

( * ) Notice: Subject to any disclaimer, the term of this patent is extended or adjusted under 35 U.S.C. 154(b) by 54 days.

This patent is subject to a terminal disclaimer.

(21) Appl. No.: 17/020,502

(22) Filed: Sep. 14, 2020

(65) Prior Publication Data

US 2020/0406569 A1 Dec. 31, 2020

Related U.S. Application Data

(60) Division of application No. 15/626,233, filed on Jun. 19, 2017, now Pat. No. 10,773,482, which is a (Continued)

(51) Int. Cl.
*B31B 50/28* (2017.01)
*B65D 5/02* (2006.01)
(Continued)

(52) U.S. Cl.
CPC ..... *B31B 50/28* (2017.08); *B31B 50/81* (2017.08); *B65D 5/029* (2013.01); *B65D 5/10* (2013.01)

(58) Field of Classification Search
CPC ..... B31B 50/28; B31B 50/81; B31B 50/30; B31B 50/32; B31B 50/34; B31B 50/36; B65D 5/029; B65D 5/10
(Continued)

(56) References Cited

U.S. PATENT DOCUMENTS

RE23,046 E 10/1948 Blanchet
2,967,655 A 1/1961 Seger, Jr.
(Continued)

OTHER PUBLICATIONS

A Canadian Office Action, dated Jun. 20, 2014, for Canadian patent application No. 2603354 (3 pgs).
MX Office Action Summary Letter; dated Oct. 12, 2011; 4 pages.

*Primary Examiner* — Sameh Tawfik
(74) *Attorney, Agent, or Firm* — Rohini K. Garg

(57) ABSTRACT

A machine for forming a container from a blank of sheet material includes an outer body frame, a mandrel mounted to the body frame, a lifting assembly coupled to the body frame, and a lateral presser assembly and a folding arm assembly coupled to the lifting assembly, wherein the lifting assembly moves the lateral presser assembly and the folding arm assembly in a first direction and an opposite, second direction. A folding arm servomechanism is operatively connected to a folding arm of the folding arm assembly and rotates the folding arm relative to the mandrel to wrap a first portion of the blank around the mandrel. A lateral presser servomechanism is operatively connected to an engaging bar of the lateral presser assembly and rotates the engaging bar relative to the mandrel to wrap a second portion of the blank around the mandrel to at least partially form the container.

10 Claims, 16 Drawing Sheets

Related U.S. Application Data continuation of application No. 13/710,102, filed on Dec. 10, 2012, now Pat. No. 9,701,088, which is a continuation of application No. 13/401,629, filed on Feb. 21, 2012, now Pat. No. 8,777,094, which is a division of application No. 11/538,342, filed on Oct. 3, 2006, now Pat. No. 8,133,163.

(51) Int. Cl.
*B65D 5/10* (2006.01)
*B31B 50/81* (2017.01)

(58) Field of Classification Search
USPC ..... 493/269
See application file for complete search history.

(56) References Cited

U.S. PATENT DOCUMENTS 3,683,755 A 8/1972 Lattke
4,066,008 A 1/1978 Arvanigian
4,242,949 A 1/1981 Auckenthaler
4,349,345 A 9/1982 Bodendoerfer
4,392,607 A 7/1983 Perkins
4,409,045 A 10/1983 Busse
4,452,596 A 6/1984 Clauss et al.
4,500,306 A 2/1985 Nowacki
4,828,244 A 5/1989 Sardella
4,931,930 A 6/1990 Shyu et al.
4,932,930 A 6/1990 Coalier et al.
5,035,683 A 7/1991 Takeda et al.
5,046,662 A 9/1991 Cowles
5,139,196 A 8/1992 Fry et al.
5,147,271 A * 9/1992 Bacques ..... B65D 5/029 493/143
5,160,307 A * 11/1992 Bacques ..... B65D 5/029 493/295
5,234,398 A 8/1993 Larsen
5,242,364 A 9/1993 Lehmann
5,256,129 A 10/1993 Boix
5,350,348 A 9/1994 Guot
5,400,955 A 3/1995 Coalier et al.
5,474,203 A 12/1995 Baker
5,593,375 A 1/1997 Franci
5,624,368 A 4/1997 Cromwell
5,656,006 A 8/1997 East et al.
5,735,785 A 4/1998 Lucas et al.
5,827,162 A 10/1998 Rubin et al.
5,867,966 A 2/1999 Mogard
5,876,319 A 3/1999 Holton
5,916,079 A 6/1999 Haring et al.
5,938,108 A 8/1999 Williams et al.
5,941,452 A 8/1999 Williams et al.
5,980,440 A 11/1999 Mitman et al.
5,992,489 A 11/1999 Busse
6,048,421 A 4/2000 White
6,106,450 A 8/2000 Brittain
6,206,816 B1 3/2001 Cook et al.
6,267,715 B1 7/2001 Sass et al.
6,319,183 B1 11/2001 Ballos
6,385,950 B1 5/2002 Anderson
6,387,028 B1 5/2002 Nishio et al.
6,689,034 B2 2/2004 Walsh et al.
6,743,191 B1 6/2004 Chang
6,827,678 B1 12/2004 Kümpel
7,322,171 B2 1/2008 Bonnain et al.
7,322,919 B2 1/2008 Malini
7,331,289 B2 2/2008 Albrecht et al.
7,338,422 B2 3/2008 Diehr et al.
7,445,589 B2 11/2008 Jaen
7,717,838 B2 5/2010 Strong et al.
7,857,743 B2 12/2010 Barner
7,935,041 B2 * 5/2011 Graham ..... B65D 5/445 493/51
8,105,223 B2 1/2012 Graham et al.
8,133,163 B2 3/2012 Strong et al.
8,323,165 B2 12/2012 Atoui
8,485,420 B2 7/2013 Barner
9,701,088 B2 * 7/2017 Strong ..... B65D 5/029
10,052,837 B2 * 8/2018 Graham ..... B31B 50/00
2003/0119640 A1 6/2003 Jaen
2003/0192945 A1 10/2003 Quaintance
2004/0005977 A1 * 1/2004 Scholtes ..... B65H 1/00 493/71
2004/0188504 A1 9/2004 Pierce
2005/0075230 A1 * 4/2005 Moshier ..... B31B 50/36 493/51
2005/0159283 A1 7/2005 Jaen
2007/0037682 A1 2/2007 Scholtes et al.
2007/0142193 A1 * 6/2007 Strong ..... B65D 5/722 493/175
2007/0191201 A1 8/2007 Reuteler et al.
2007/0228119 A1 * 10/2007 Barner ..... B65D 5/48024 229/109
2008/0039308 A1 2/2008 Herrin
2008/0078819 A1 4/2008 Strong et al.
2008/0099541 A1 * 5/2008 Smith ..... B65D 5/443 229/109
2008/0120947 A1 5/2008 Oldsen et al.
2008/0120948 A1 5/2008 Martin et al.
2008/0250759 A1 10/2008 Cash
2009/0098991 A1 4/2009 Graham et al.
2009/0170678 A1 7/2009 Smith et al.
2010/0219232 A1 9/2010 Smith
2011/0065559 A1 3/2011 Atoui
2011/0281705 A1 11/2011 Aganovic et al.
2012/0100976 A1 4/2012 Graham et al.

* cited by examiner

MACHINE AND METHOD FOR FORMING A CONTAINER

CROSS REFERENCE TO RELATED APPLICATIONS

This is a Divisional application of U.S. patent application Ser. No. 15/626,233, filed Jun. 19, 2017, entitled "BLANK AND MACHINE FOR FORMING A CONTAINER", which is a Continuation application of U.S. patent application Ser. No. 13/710,102, filed Dec. 10, 2012, entitled "MACHINE FOR FORMING A CONTAINER", issued as U.S. Pat. No. 9,701,088, which is a Continuation application of U.S. patent application Ser. No. 13/401,629, filed Feb. 21, 2012, entitled "BLANK AND METHODS AND APPARATUS FOR FORMING A BARREL FROM THE BLANK", issued as U.S. Pat. No. 8,777,094, which is a Divisional application of U.S. patent application Ser. No. 11/538,342, filed Oct. 3, 2006, entitled "BLANK AND METHODS AND APPARATUS FOR FORMING A BARREL FROM THE BLANK", issued as U.S. Pat. No. 8,133,163, the disclosures of all of which are hereby incorporated herein by reference in their entireties.

BACKGROUND OF THE INVENTION

This invention relates generally to containers formed from sheet material, and more specifically to corrugated barrels, blanks of sheet material for producing corrugated barrels, and methods and apparatus for forming corrugated barrels.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks that are folded along a plurality of preformed fold lines to form an erected corrugated container.

In the case of a corrugated barrel, when the blank is folded, different panels and/or flaps overlap to form a manufacturer's joint, a bottom of an erected corrugated barrel, and a top of the erected corrugated barrel. Because such erected barrels are often used to transport and store various products having various loads therein, the sealing of the manufacturer's joint and the barrel bottom, and the closing of the barrel top should be considered during manufacturing of the blank and the barrel.

However, due to the complexity of at least some known blanks and corrugated barrels, such blanks and corrugated barrels are difficult and time consuming to manufacture. Moreover, because of increased costs, at least some known corrugated barrels are simply designed in an effort to reduce costs, manufacturing time, and labor, which oftentimes results in inadequate sealing of the manufacturer's joint and the barrel bottom, and inadequate closing of the barrel top. As a result, products contained within the barrel may undesirably fall and/or spill out of the barrel thereby causing damage to the products.

BRIEF DESCRIPTION OF THE INVENTION

In one aspect, the present invention includes a machine for forming a container from a blank of sheet material. The machine includes an outer body frame, a mandrel mounted to the body frame and having an external shape complimentary to an internal shape of at least a portion of the container, the mandrel comprising a central longitudinal axis and a plurality of side faces, wherein the blank includes a plurality of side panels, the blank positionable beneath the mandrel, a lifting assembly coupled to the body frame, a lateral presser assembly and a folding arm assembly coupled to the lifting assembly, wherein the lifting assembly moves the lateral presser assembly and the folding arm assembly in a first direction and an opposite, second direction perpendicular to the longitudinal axis of the mandrel, a folding arm servomechanism operatively connected to a folding arm of the folding arm assembly, the folding arm rotatably mounted, wherein the folding arm servomechanism electrically controls at least one of a speed and a timing of rotational movement of the folding arm independently of a speed and a timing of movement of the lifting assembly, the folding arm servomechanism rotating the folding arm relative to the mandrel to wrap a first portion of the blank around the mandrel, and a lateral presser servomechanism operatively connected to an engaging bar of the lateral presser assembly, the engaging bar rotatably mounted, wherein the lateral presser servomechanism electrically controls at least one of a speed and a timing of rotational movement of the engaging bar independently of the speed and the timing of movement of the lifting assembly, the lateral presser servomechanism rotating the engaging bar relative to the mandrel to wrap a second portion of the blank around the mandrel to at least partially form the container.

In another aspect, the present invention includes a method for forming a container from a blank of sheet material using a machine including an outer body frame and a mandrel mounted to the body frame and having an external shape complimentary to at least a portion of the container. The method includes moving a lateral presser assembly and a folding arm assembly in a first direction and an opposite, second direction perpendicular to a longitudinal axis of the mandrel, the lateral presser assembly and the folding arm being coupled to a lifting assembly, the lifting assembly coupled to the body frame, rotating a folding arm of the folding arm assembly relative to the mandrel to wrap a first portion of the blank around the mandrel, including using a folding arm servomechanism to electrically control at least one of a speed and a timing of the rotational movement of the folding arm independently of a speed and a timing of movement of the lifting assembly, and rotating an engaging bar of the lateral presser assembly relative to the mandrel to wrap a second portion of the blank around the mandrel to at least partially form the container, including using a lateral presser servomechanism to electrically control at least one of a speed and a timing of the rotational movement of the engaging bar independently of the speed and the timing of movement of the lifting assembly.

DETAILED DESCRIPTION OF THE INVENTION

The exemplary blank, corrugated barrels, and methods and apparatus for forming corrugated barrels described herein overcome the structural disadvantages of known blanks and barrels by facilitating secure sealing of the manufacturer's joint and the barrel bottom, and secure closing of the barrel top. The example embodiment of the blank and container described herein includes a corrugated barrel. However, the processes and systems described herein are not limited in any way to corrugated barrels. Rather, the processes and systems described herein can be applied to a plurality of container types manufactured from a plurality of materials.

Figure 1:
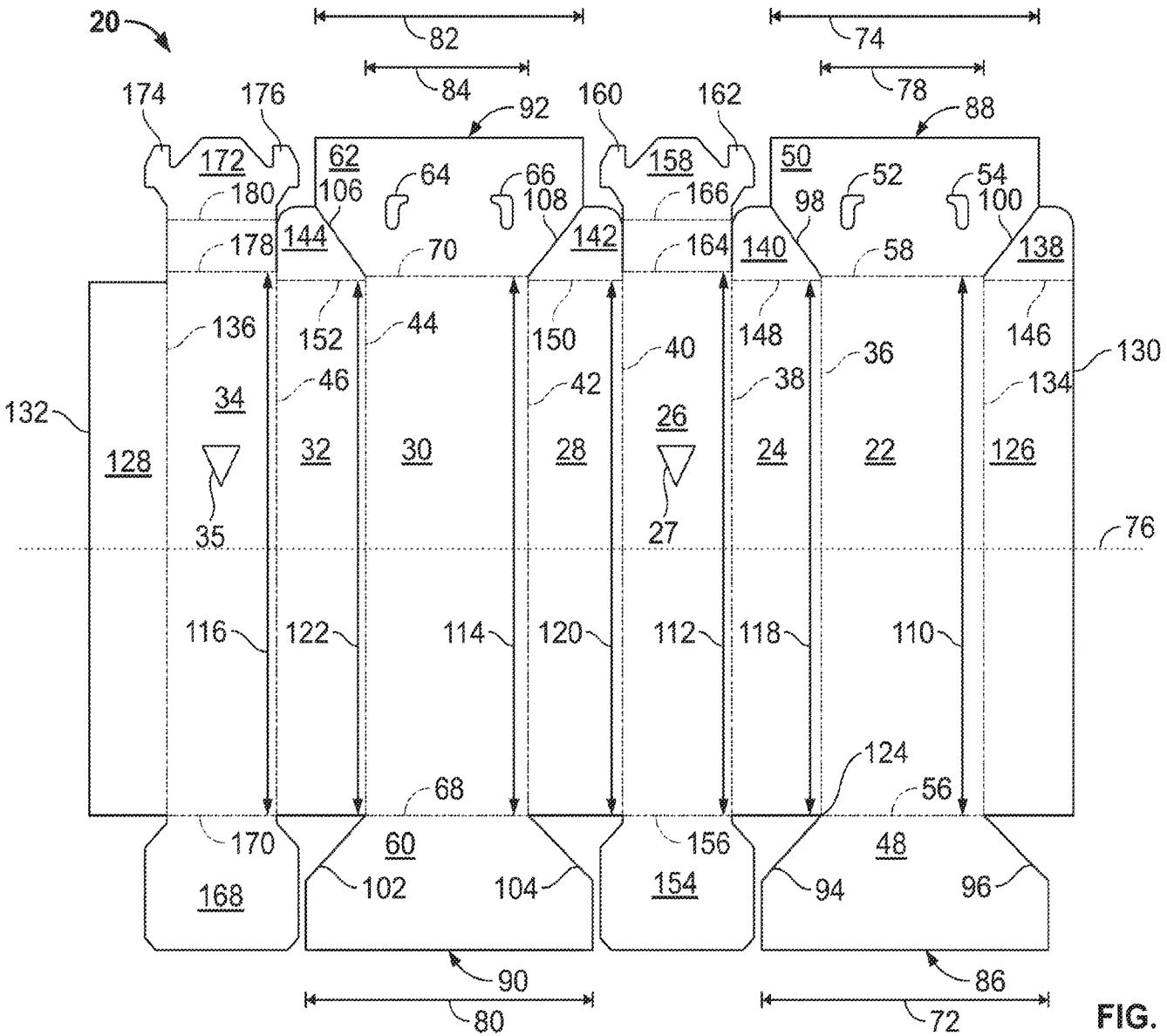
FIG. 1 is a top plane view of an exemplary embodiment of a blank of sheet material.

FIG. 1 illustrates a top plan view of an exemplary embodiment of a substantially flat blank 20 of sheet material. As shown in FIG. 1, the blank includes a succession of aligned wall panels and end panels connected together by a plurality of preformed, generally parallel, fold lines. The aligned panels include a succession of seven wall panels 22, 24, 26, 28, 30, 32, 34 connected together by a plurality of preformed, generally parallel, fold lines 36, 38, 40, 42, 44, 46, respectively. Specifically, the seven wall panels include a front panel 22, a first angled front-side panel 24, a first side panel 26, a first angled back-side panel 28, a back panel 30, a second angled back-side panel 32, and a second side panel 34. The first angled front-side panel 24 extends from the front panel 22 along fold line 36, the first side panel 26 extends from the first angled front-side panel 24 along fold line 38, the first angled back-side panel 28 extends from the first side panel 26 along fold line 40, the back panel 30 extends from the first angled back-side panel 28 along fold line 42, the second angled back-side panel 32 extends from the back panel 30 along fold line 44, and the second side panel 34 extends from the second angled back-side panel 32 along fold line 46. The first and second side panels 26, 34 also include a respective directional marks 27, 35 indicating a direction of a bottom of an erected barrel (shown in FIGS. 2-4).

The front panel 22 includes a pair of opposing front flaps 48, 50 extending therefrom. Specifically, the front flaps 48, 50 include a bottom front flap 48 and a top front flap 50. The top front flap 50 includes a plurality of slots 52, 54. The bottom front flap 48 and the top front flap 50 extend from the front panel 22 along a pair of opposing preformed, generally parallel, fold lines 56, 58, respectively. Similarly, the back panel 30 includes a pair of opposing back flaps 60, 62 extending therefrom. Specifically, the back flaps 60, 62 include a bottom back flap 60 and a top back flap 62. The top back flap 62 includes a plurality of slots 64, 66. The bottom back flap 60 and the top back flap 62 extend from the back panel 30 along a pair of opposing preformed, generally parallel, fold lines 68, 70, respectively. The fold lines 56, 58, 68, 70 are generally parallel to each other and generally perpendicular to the fold lines 36, 38, 40, 42, 44, 46. The bottom front flap 48 has a length 72 and the top front flap 50 has a length 74 taken along a central horizontal axis 76 of the blank 20 that is greater than a length 78 of the front panel 22 also taken along the central horizontal axis 76. Similarly, the bottom back flap 60 has a length 80 and the top back flap 62 has a length 82 taken along the central horizontal axis 76 of the blank 20 that is greater than a length 84 of the back panel 30 also taken along the central horizontal axis 76.

Each of the front flaps 48, 50 includes an outer edge (generally designated by 86, 88, respectively) defining a perimeter of the flap. Similarly, each of the back flaps 60, 62 includes an outer edge (generally designated by 90, 92, respectively) defining a perimeter of the flap. The outer edges 86, 88, 90, 92 each include opposite edge portions 94, 96, 98, 100, 102, 104, 106, 108 that are each obliquely angled with respect to respective fold lines 56, 58, 68, 70. Although other angles may be used without departing form the scope of the present invention, in one embodiment, the edge portions 94, 96, 98, 100, 102, 104, 106, 108 are angled at about 45.degree. with respect to the respective fold lines 56, 58, 68, 70.

Figure 2:
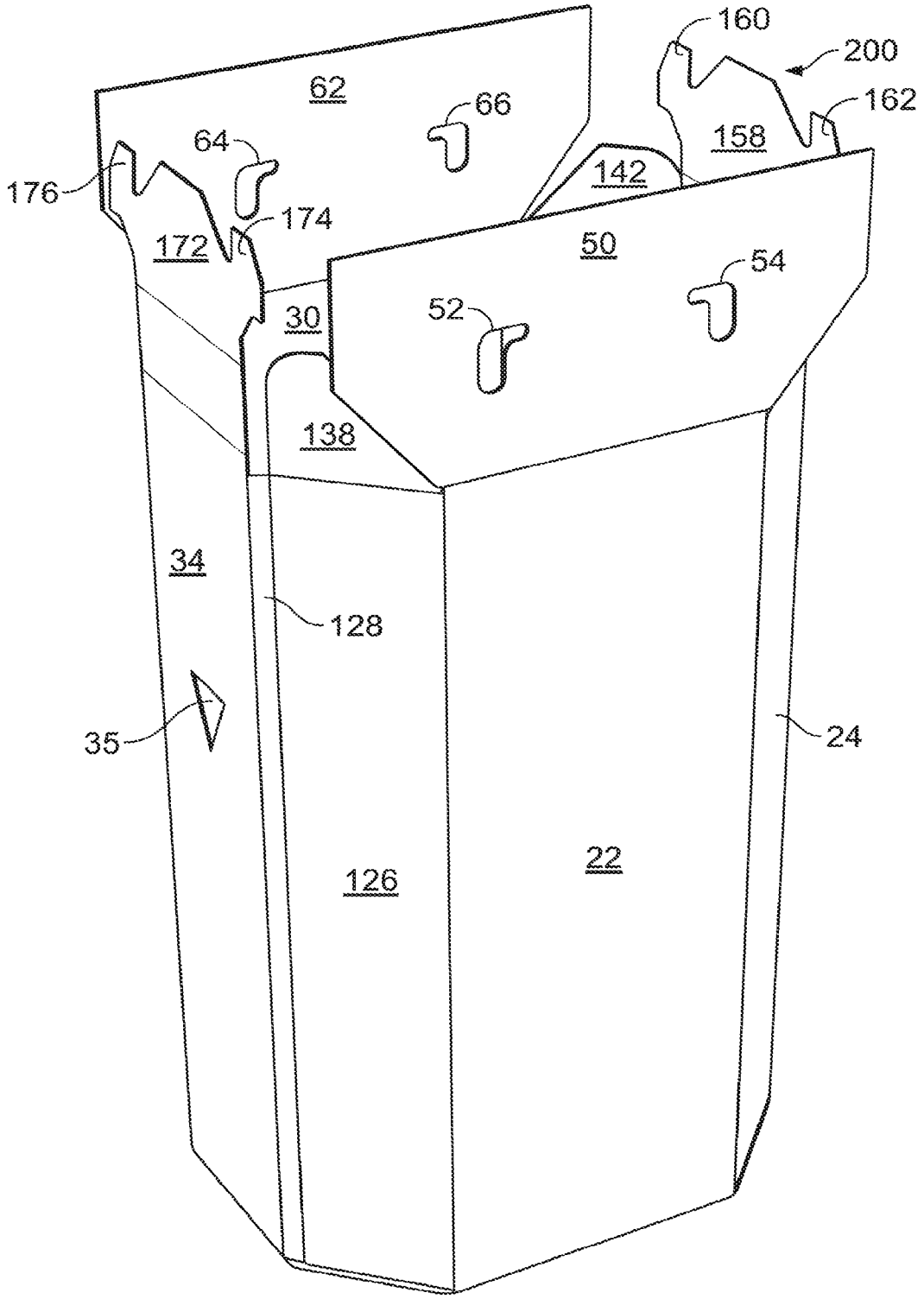
FIG. 2 is perspective view of an exemplary embodiment of a corrugated barrel that may be formed from the blank shown in FIG. 1.
Figure 3:
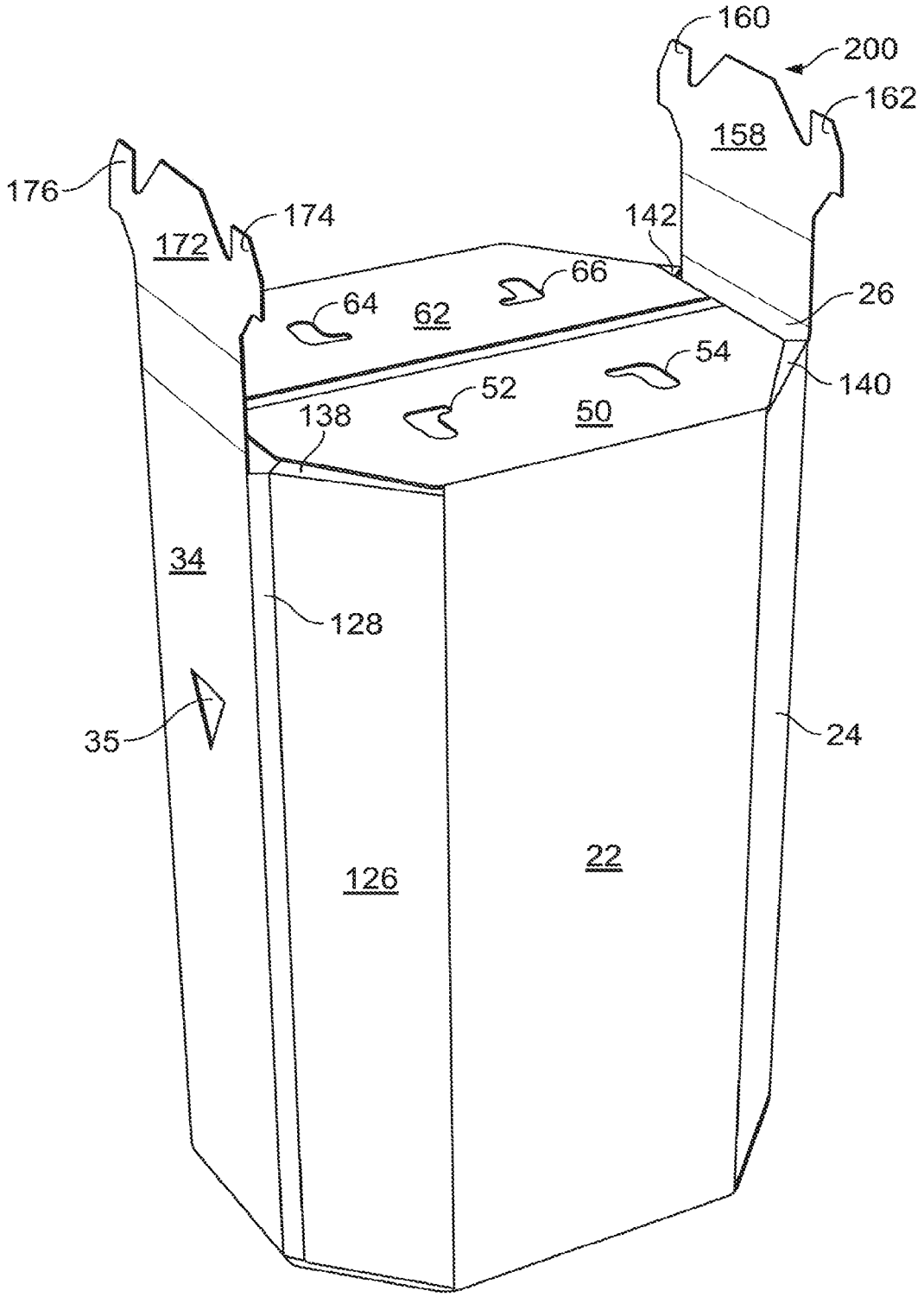
FIG. 3 is a perspective view of the corrugated barrel shown in FIG. 2 in a partially closed state.
Figure 4:
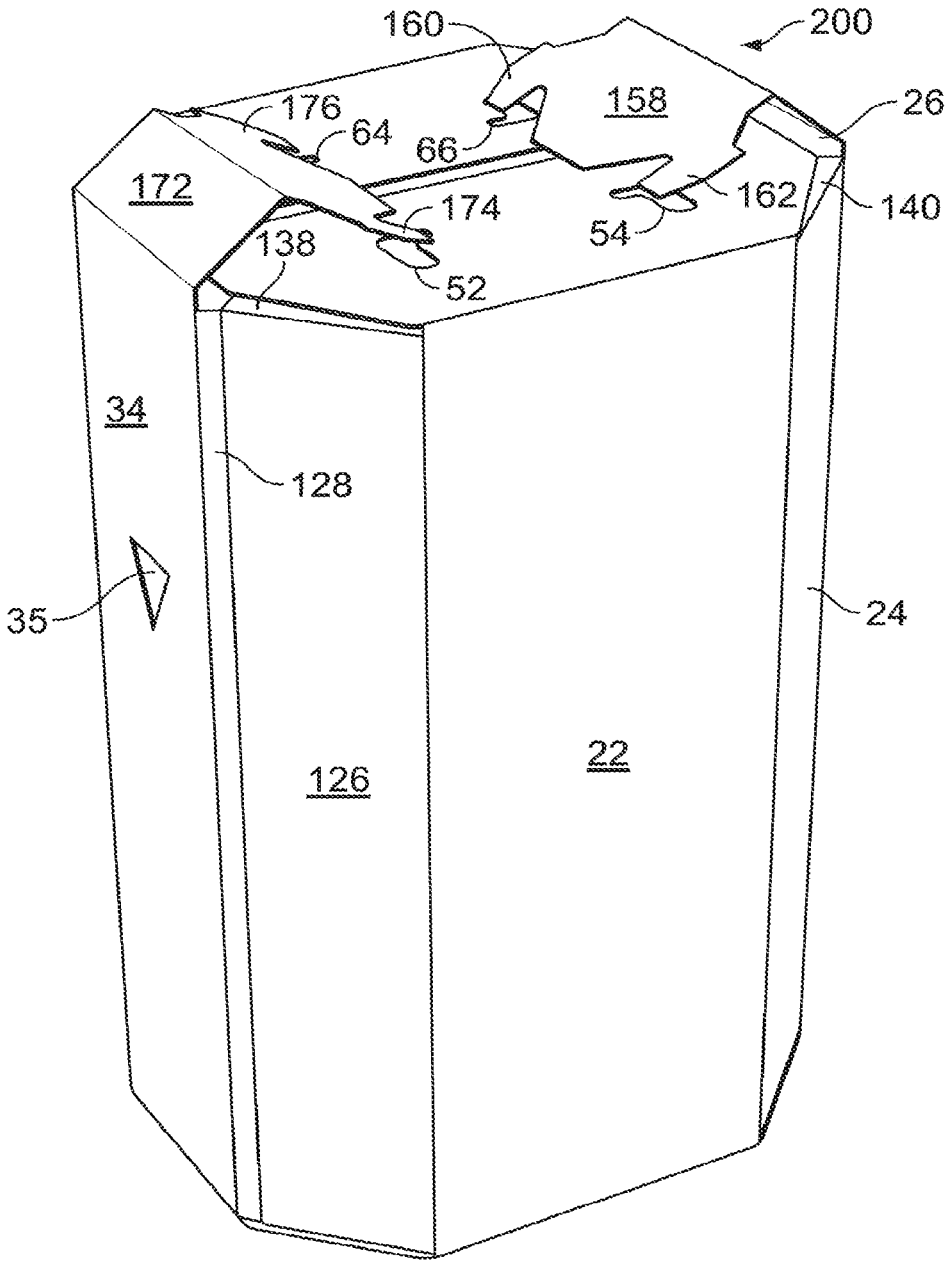
FIG. 4 is a perspective view of the corrugated barrel shown in FIG. 3 in another partially closed state.

As will be described in more detail below, the shape, size, and arrangement of the front flaps 48, 50 and the back flaps 60, 62 as shown in FIG. 1 and described above facilitates forming a barrel having angled corners, an example of which is shown in FIGS. 2-4. More specifically, the shape, size, and arrangement of the front flaps 48, 50 and the back flaps 60, 62 facilitates forming a barrel having wall panels (e.g., the first angled front-side panel 24, the first angled back-side panel 28, the second angled back-side panel 32, and end panels (described below)) that are obliquely angled with respect to, and interconnect the front panel 22, the first side panel 26, the back panel 30, and the second side panel 34 of the formed case.

Each of the front panel 22, the first side panel 26, the back panel 30, and the second side panel 34 has a respective width 110, 112, 114, 116. Although the widths 110, 112, 114, 116 may be different widths without departing form the scope of the present invention, in the embodiment shown in FIG. 1 (and additionally the exemplary barrel shown in FIGS. 2-4), the widths 110, 112, 114, 116 are substantially equal. Additionally, each of the first angled front-side panel 24, the first angled back-side panel 28, and the second angled back-side panel 32 has a respective width 118, 120, 122. Although the widths 118, 120, 122 may be different widths without departing form the scope of the present invention, in the embodiment shown in FIG. 1 (and additionally the exemplary barrel shown in FIGS. 2-4), the widths 118, 120, 122 are substantially equal.

As shown in FIG. 1, the widths 118, 120, 122 are less than the widths 110, 112, 114, 116 to accommodate a thickness of the flaps 48, 50, 60, 62, respectively, when the flaps are folded about the respective fold lines 56, 58, 68, 70 to form a barrel. As is described below, accommodating the thickness of the flaps 48, 50, 60, 62 facilitates reducing gaps within an exterior of a formed barrel. Although the widths 118, 120, 122 may be less than the widths 110, 112, 114, 116 by any value without departing form the scope of the present invention, in one embodiment, the widths 118, 120, 122 are less than the widths 110, 112, 114, 116 by a value substantially equal to a thickness of the flaps 48, 50, 60, 62. Alternatively, the widths 118, 120, 122 may be substantially equal to the widths 110, 112, 114, 116 and the edge portions 94, 96, 98, 100, 102, 104, 106, 108 may be offset from the respective angled front-side panel 24, first angled back-side panel 28, and second angled back-side panel 32 along the central horizontal axis 76 to accommodate a thickness of the flaps when the flaps 48, 50, 60, 62 are folded to form a barrel. For example, the edge portion 94 may intersect the front panel 22 at a location offset along the central horizontal axis 76 from an intersection 124 between the front panel 22 and the front-side panel 24, and more specifically between the fold line 36 and the fold line 56.

The end panels include a plurality of end panels 126, 128 aligned with and positioned on opposing sides of the wall panels 22, 24, 26, 28, 30, 32, 34. Specifically, the end panels 126, 128 are connected to the front panel 22 and the second side panel 34 by a plurality of preformed, generally parallel, fold lines 134, 136, respectively. The end panels 126, 128 include a first end panel 126 and a second end panel 128. First end panel 126 includes a trailing edge 130 and second end panel 128 includes a leading edge 132. The first end panel 126 extends from the front panel 22 along fold line 134. The second end panel 128 extends from the second side panel 34 along fold line 136. The fold lines 134, 136 are generally parallel to the fold lines 36, 38, 40, 42, 44, 46.

As shown in FIG. 1, the end panel 126, the angled front-side panel 24, first angled back-side panel 28, and second angled back-side panel 32 include a top end panel flap 138, a top front-side panel flap 140, a top first angled back-side panel flap 142, and a top second angled back-side panel flap 144, respectively. The top end panel flap 138 extends from the first end panel 126 along a fold line 146, the top front-side panel flap 140 extends from the angled front-side panel 24 along a fold line 148, the top first angled back-side panel flap 142 extends from the first angled back-side panel 28 along a fold line 150, and the top second angled back-side panel flap 144 extends from the second angled back-side panel 32 along a fold line 152. The fold lines 136, 148, 150, 152 are generally parallel to each other and generally perpendicular to the fold lines 36, 38, 40, 42, 44, 46. As a result, the top end panel flap 138, the top front-side panel flap 140, the top first angled back-side panel flap 142, and the top second angled back-side panel flap 144 facilitate proving additionally closure flaps so that products contained within a closed erected barrel do not fall out and potentially damage such products.

The first side panel 26 includes a bottom first side flap 154 extending therefrom along a preformed fold line 156. The first side panel 26 also includes a top first side flap 158 including a plurality of hooked protrusions 160, 162 and extending along a preformed fold line 164. Because the hooked protrusions 160, 162 engage and hook to edges of slots 52, 66, respectively, the top first side flap 158 facilitates reducing disengagement of the hooked protrusions 160, 162 from the respective engaged slots 52, 66 so that various products contained within an erected barrel will not fall out and potentially damage such products. Additionally, the top first side flap 158 also includes an intermediate fold line 166 to facilitate inserting and engaging hooked protrusions 160, 162 within slots 52, 66, respectively. The fold lines 156, 164, 166 are generally parallel to each other and generally perpendicular to the fold lines 36, 38, 40, 42, 44, 46

Similarly, the second side panel 34 includes a bottom second side flap 168 extending therefrom along a preformed fold line 170. The second side panel 34 also includes a top second side flap 172 including a plurality of hooked protrusions 174, 176 and extending along a preformed fold line 178. Because the hooked protrusions 174, 176 engage and hook to edges of slots 64, 54, respectively, the top second side flap 172 facilitates reducing disengagement of the hooked protrusions 174, 176 from the respective engaged slots 64, 54 so that various products contained within an erected barrel will not fall out and potentially damage such products. Additionally, the top second side flap 172 also includes an intermediate fold line 180 to facilitate inserting and engaging hooked protrusions 174, 176 within slots 64, 54, respectively. The fold lines 170, 178, 180 are generally parallel to each other and generally perpendicular to the fold lines 36, 38, 40, 42, 44, 46.

Each of the bottom first side flap 154 and the bottom second side flap 168 includes an outer edge defining a perimeter of the flap. The outer edges include opposite edge portions that are each obliquely angled with respect to respective fold lines 156, 170. Although other angles may be used without departing form the scope of the present invention, in one embodiment, the edge portions are angled at about 45.degree. with respect to the respective fold lines 156, 170. As will be described in more detail below, the shape, size, and arrangement of the first side flaps 154, 158 and the second side flap 168, 172 as shown in FIG. 1 and described above facilitates forming a barrel having angled corners, an example of which is shown in FIGS. 2-4. More specifically, the shape, size, and arrangement of the first side flaps 154, 158 and the second side flap 168, 172 facilitates forming a barrel having wall panels (e.g., the first angled front-side panel 24, the first angled back-side panel 28, the second angled back-side panel 32, and end panels 126, 128) that are obliquely angled with respect to, and interconnect the front panel 22, the first side panel 26, the back panel 30, and the second side panel 34 of the formed case.

As a result of the above exemplary embodiment of the blank 20, a manufacturer's joint, a barrel bottom, and a barrel top formed therefrom may be securely closed so that various products may be securely contained within such erected barrel. Therefore, less material may be used to fabricate a blank having suitable strength for construction of a barrel that can contain various loads.

As will be described below in more detail with reference to FIG. 5-19, the blank is intended to form a barrel as shown in FIG. 2-4 (designated in its entirety by 200) by wrapping and/or fastening the panels 22, 24, 26, 28, 30, 32, 34, 126, 128, and the flaps 48, 60, 154, 168 (shown in FIG. 1). Of course, blanks having shapes, sizes, and configurations different than the blank 20 described and illustrated herein may be used to form corrugated barrel 200 shown in FIGS. 2-4 without departing form the scope of the present invention.

FIG. 2 illustrates a perspective view of an exemplary corrugated barrel 200, which is erected and opened, that may be formed from the blank 20 (shown in FIG. 1). FIG. 3 illustrates a perspective view of the corrugated barrel 200 (shown in FIG. 2) in a partially closed state. FIG. 4 illustrates a perspective view of the corrugated barrel 200 (shown in FIG. 3) in a partially closed state. In the exemplary embodiment, the front panel 22, the first side panel 26, the back panel 30, and the second side panel 34 form exterior front, right-side, back, left-side panels, respectively, of the barrel 200. The first angled front-side panel 24 connects the front panel 22 to the first side panel 26, the first angled back-side panel 28 connects the first side panel 26 to the back panel 30, the second angled back-side panel 32 connects to back panel 30 to the second side panel 34, and the first and second end panels 126, 128 connect the second side panel 34 to the front panel 22. Also, the flaps 48, 60,154, 168 form bottom panels of the barrel 200. Further, the flaps 50, 62, 138, 140, 142, 144, 158, 172 a form top panels of the barrel 200.

Although the barrel 200 may have other orientations without departing form the scope of the present invention, in the embodiments shown in FIG. 2-4, the front and back panels are substantially parallel to each other, the first and second side panels 26, 34 are substantially parallel to each other, the first angled front-side panel 24 and the second angled back-side panel 32 are substantially parallel to each other, and the first angled back-side panel 28, first end panel 126, and the second end panel 128 are substantially parallel to each other. The first angled front-side panel 24, the first angled back-side panel 28, the second angled back-side panel 32, and the end panels 126, 128 are obliquely angled with respect to the panels they interconnect to form angled corners of the barrel 200. More specifically, the first angled front-side panel 24 is obliquely angled with respect to the front panel 22 and the first side panel 26, the first angled back-side panel 28 in obliquely angled with respect to the first side panel 26 and the back panel 30, the second angled back-side panel 32 is oblique angled with respect to the back panel 30, and the second side panel 34, and the first and second end panels 126, 128 are obliquely angled with respect to the front panel 22 and the second side panel 34.

The flaps 48, 60, 154, 168 are each orientated generally perpendicular to the wall panels 22, 24, 26, 28, 30, 32, 34 and the end panels 126, 128 to form bottom panels of the barrel 200. More specifically, bottom front and back side flap 154, 168 are folded beneath/inside of the bottom front and back flaps 48, 60. Similarly, in a fully closed position (not shown), the flaps 50, 62, 138, 140, 142, 144, 158, 172 are each orientated generally perpendicular to the wall panels 22, 24, 26, 28, 30, 32, 34 and the end panels 126, 128 to form top panels of the barrel 200. More specifically, the top flaps 138, 140, 142, 144 are folded beneath/inside of the top flaps 158, 172, which are in turn folded beneath/inside of the top front and back flaps 50, 62.

Although the barrel 200 may be secured together using any suitable fastener at any suitable location on the barrel 200 without departing from the scope of the present invention, in one embodiment, adhesive (not shown) is applied to an inner surface and/or an outer surface of the first and second end flaps 126, 128, respectively, to secure the wall and end panels of the barrel 200. In one embodiment, adhesive may also be applied to exterior surfaces of side flaps 154, 168 and/or interior surfaces of front and back flaps 48, 60 to secure front and back flaps 48, 60 to side flaps 154, 168.

As discussed above, to facilitate reducing gaps in the fully closed barrel 200 and to generally accommodate interconnection of the front and back flaps 48, 50, 60, 62 with the panels 24, 28, 32, 126, 128, the widths 118, 120, 122 and end panel widths (shown in FIG. 1) may be less than the widths 110, 112, 114, 116 (shown in FIG. 1) of the front, first side, second side, and back panels 22, 26, 30, 34 to accommodate a thickness of the flaps 48, 50, 60, 62, 138, 140, 142, 144, 154, 168. Accordingly, as shown in FIG. 3, exterior surfaces of flaps 138, 140, 142, 144 rest against interior surfaces of flaps 50, 62. As shown in FIG. 4, exterior surfaces of flaps 50, 62 rest against interior surfaces of flaps 158, 172. More specifically, in the fully closed barrel 200, hooked protrusions 160, 162 are substantially inserted within slots 66, 54, respectively, and hooked protrusions 174, 176 are substantially inserted within slots 52, 64, respectively. Further, exterior surfaces of flaps 154, 168 rest against interior surfaces of flaps 48, 60.

As a result of the above exemplary embodiment of the erected corrugated barrel 200, the manufacturer's joint, the barrel bottom, and the barrel top may be securely closed so that various products may be securely contained within the barrel 200. Therefore, less material may be used to fabricate a stronger barrel 200.

Figure 5:
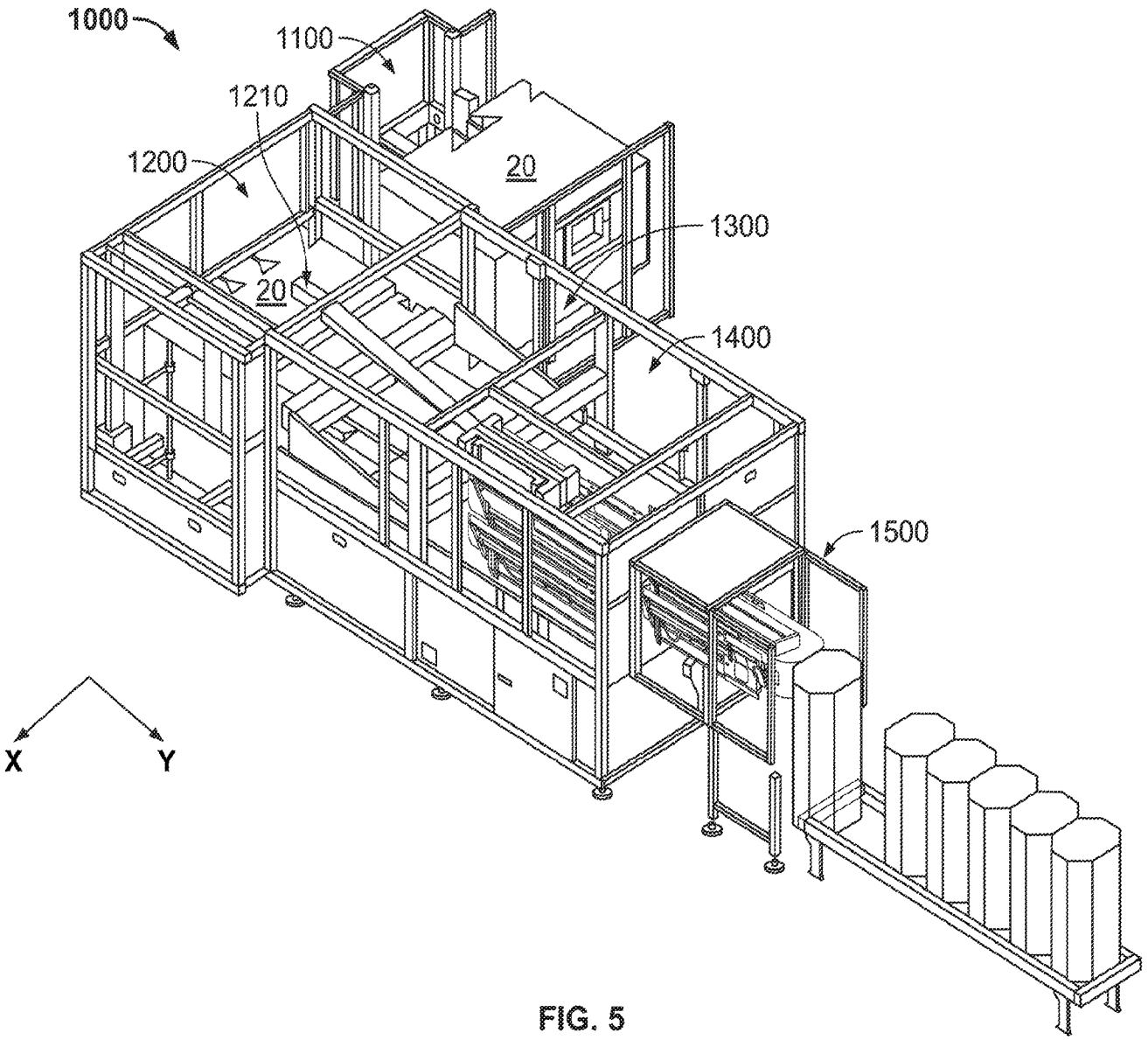
FIG. 5 is a perspective view of an exemplary embodiment of a machine that may be used to form a corrugated barrel from the blank of sheet material shown in FIG. 1.
Figure 6:
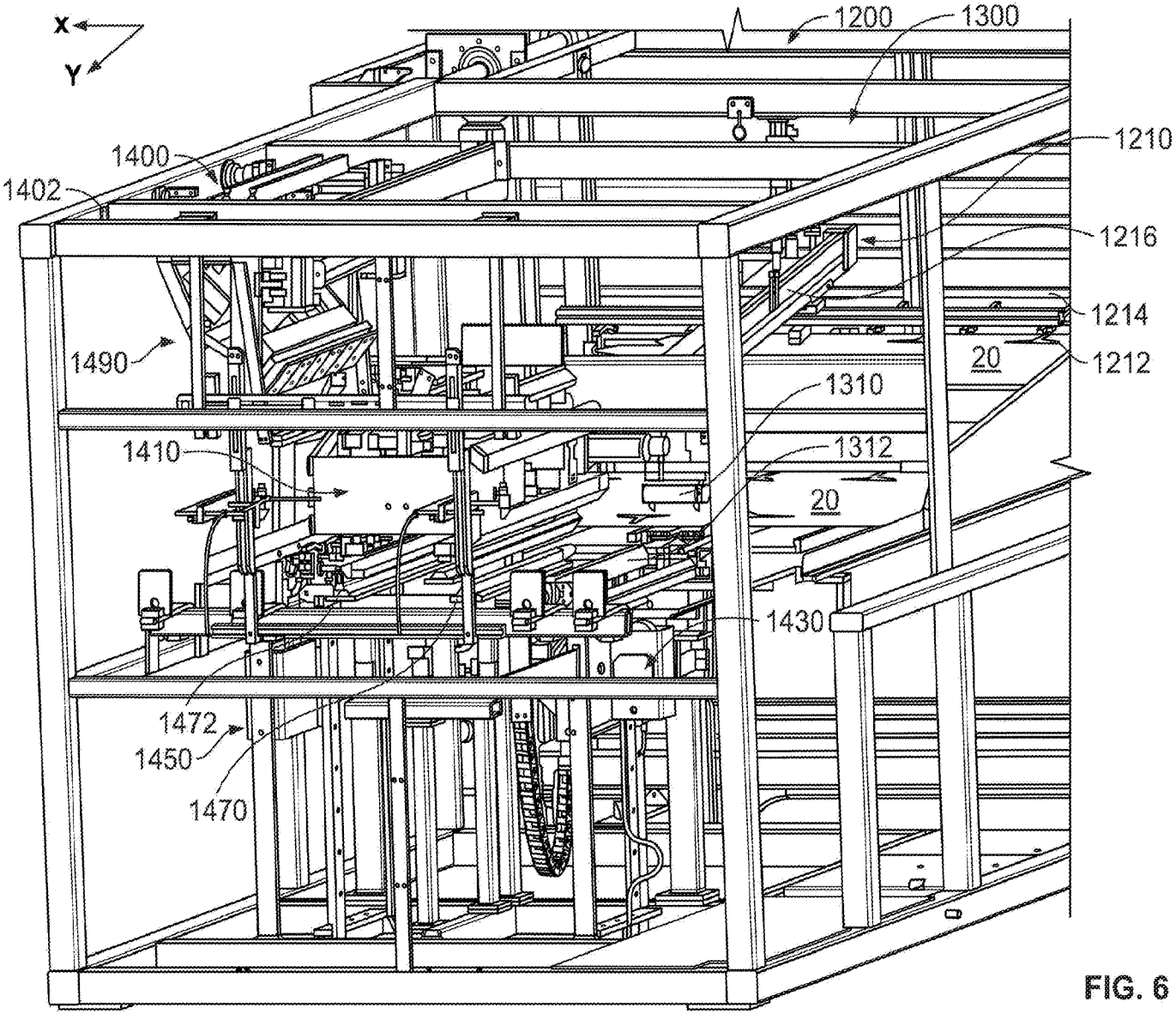
FIG. 6 is a perspective view of a blank forming section of the machine shown in FIG. 5.

FIG. 5 illustrates a perspective view of an exemplary a machine (generally designated by 1000) for forming a barrel (e.g., the corrugated barrel 200 shown in FIG. 2-4) from a blank of sheet material (e.g., the blank 20 shown in FIG. 1). FIG. 6 illustrates another perspective view of a blank forming section of the machine 1000. The machine 1000 will be discussed thereafter with reference to forming the corrugated barrel 200 from the blank 20. However, the machine 1000 may be used to form a barrel or any other container having any size, shape, or configuration from a blank having any size, shape, or configuration without departing from the scope of the present invention.

As shown in FIG. 5, the machine 1000 includes a loading section 1100, an elevator section 1200, a transfer section 1300, a blank folding section 1400, and an outfeed section 1500. The loading section 1100 is positioned in the front of the machine 1000 with respect to a sheet loading direction X. The elevator section 1200 in positioned in the back of the machine 1000 with respect to the sheet loading direction X. Moreover, the elevator section 1200 is positioned upstream in the machine 1000 with respect to a sheet transfer direction Y. Further, the transfer section 1300, the blank folding section 1400, and the outfeed section 1500 are sequentially positioned downstream in the machine 1000 with respect to the elevator section 1200 and with respect to each other.

In the exemplary embodiment, the loading section 1100 includes a conveyor (not shown) for receiving a bundle including a plurality of blanks 20. The blanks 20 are orientated so that the leading edge 132 of the second end panel 128 (shown in FIG. 1) may be initially loaded onto the conveyor manually, by a forklift, or by any other loading device. The loading section 1100 may also include an alignment device (not shown) such as, but not limited to, a stack presser or any other device that justifies the blanks 20. After the blanks 20 are loaded onto the conveyor and/or aligned, the bundle of blanks 20 is conveyed, in the sheet loading direction X, from the loading section 1100 to the elevator section 1200.

As shown in FIGS. 5 and 6, the elevator section 1200 includes an elevator stop (not shown), an alignment device (not shown), an elevator (not shown), and a portion of a gripping mechanism. The elevator stop is positioned toward a back of the elevator section to facilitate aligning the bundle of blanks 20 with the alignment device. The elevator includes a support plate (not shown) and a motor (not shown) and/or any other lifting device and lowering device. The support plate supports the bundle of blanks 20 thereon. The motor raises and lowers the support plate so that the bundle of blanks 20 may also be raised/lowered, respectively.

As shown in FIGS. 5 and 6, the gripping mechanism may include any suitable structure and/or means that may be used to attach to a topmost blank 20 and lift the blank 20 out of the elevator section 1200 and transfer it to the transfer section 1300 without departing form the scope of the present invention. In one embodiment, the gripping mechanism includes a vacuum transfer assembly 1210 including a plurality of vacuum cups 1212, a sliding frame 1214, a fixed frame 1216, and a servo motor (not shown). The vacuum cups 1212 are attached to the sliding frame 1214. The vacuum cups 1212 include independent vacuum generators (not shown) for providing suction to attach the vacuum cups 1212 to the individual blanks 20. The sliding frame 1214 is slidably coupled to the fixed frame 1216 that extends between the elevator section 1200 and the transfer section 1300.

During operation, the vacuum cups 1212 attach to the topmost blank 20 and grip the blank 20 as the sliding frame 1214 moves on the fixed frame 1216 to transfer the blank 20, in the sheet feed direction Y, from the elevator section 1200 to the transfer section 1300. In the transfer section 1300, the vacuum cups 1212 release the blank 20 and the sliding frame 1214 retracts to the elevator section 1200 to attach to the next topmost blank 20 in the elevator section 1200.

The transfer section 1300 includes a support plate (not shown), a servo transfer assembly 1310, a gluing assembly 1312, and a servo motor (not shown). The support plate supports the blank 20 in the transfer section 1300. The servo transfer assembly includes an idler roller 1310 and a transfer bar (not shown) that is controlled by the servo motor to engage a topmost/interior surface of the blank 20 and transfer the blank 20 from the transfer section 1300 to the blank folding section 1400. More specifically, the idler roller 1310 forces the blank 20 down onto the gluing assembly 1312. The transfer bar is mounted on a linear rail (not shown) and is driven by the servo motor to transfer the blank 20 over the gluing assembly 1312.

The gluing assembly 1312 engages a bottommost/exterior surface of the blank 20 to apply adhesive to certain predetermined panels and flaps of the blank. For example, the gluing assembly 1312 may apply adhesive (not shown) to bottom/exterior surfaces of the second end panel 128, bottom first side flap 154, and/or bottom second side flap 168 (all shown in FIG. 1). However, as discussed previously, adhesive may be applied to interior and/or exterior surfaces of any panel or flap of the blank 20 that may require adhesive. After adhesive is applied, the servo transfer assembly 1310 guides the blank 20 along the support plate until the blank 20 is positioned underneath a mandrel located in the blank folding section 1400.

Figure 7:
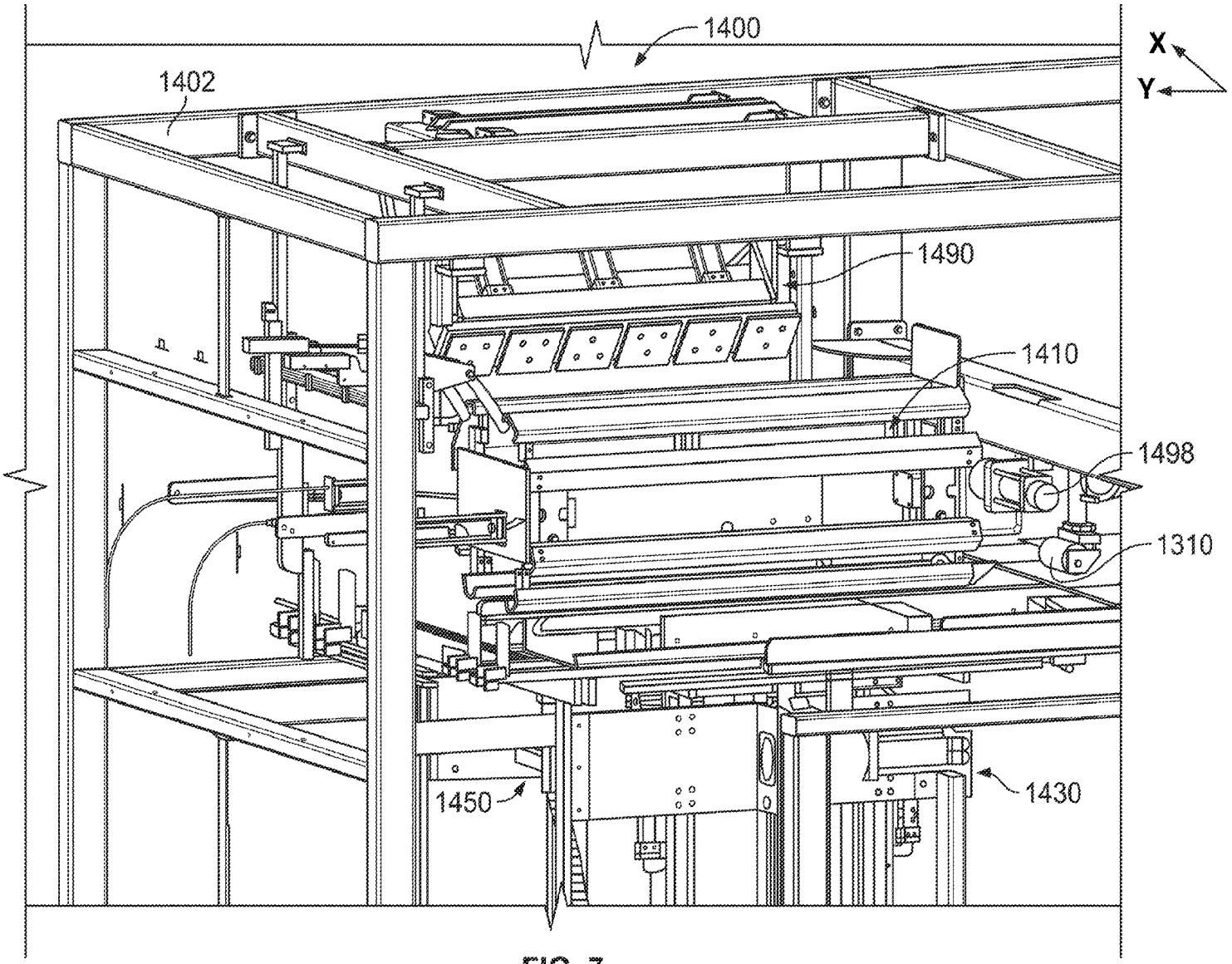
FIG. 7 is another perspective view of the blank folding section of the machine shown in FIG. 6.

FIG. 7 illustrates a perspective view of the blank folding section 1400 of the machine 1000 (shown in FIG. 6). As shown in FIGS. 6 and 7, the blank folding section 1400 includes an outer body frame 1402, a collapsible mandrel 1410, a servo lifting assembly including a lateral presser assembly 1430 and a folding arm assembly 1450. The blank folding section 1400 also includes flap folder assemblies, miter bars 1470, 1472, an end panel presser assembly 1490, and an eject servo 1498. The mandrel 1410, the lateral presser assembly 1430, the folding arm assembly 1450, the flap folder assemblies, and the end panel presser assembly 1490 are mounted, directly or indirectly, to the body frame 1402.

Figure 8:
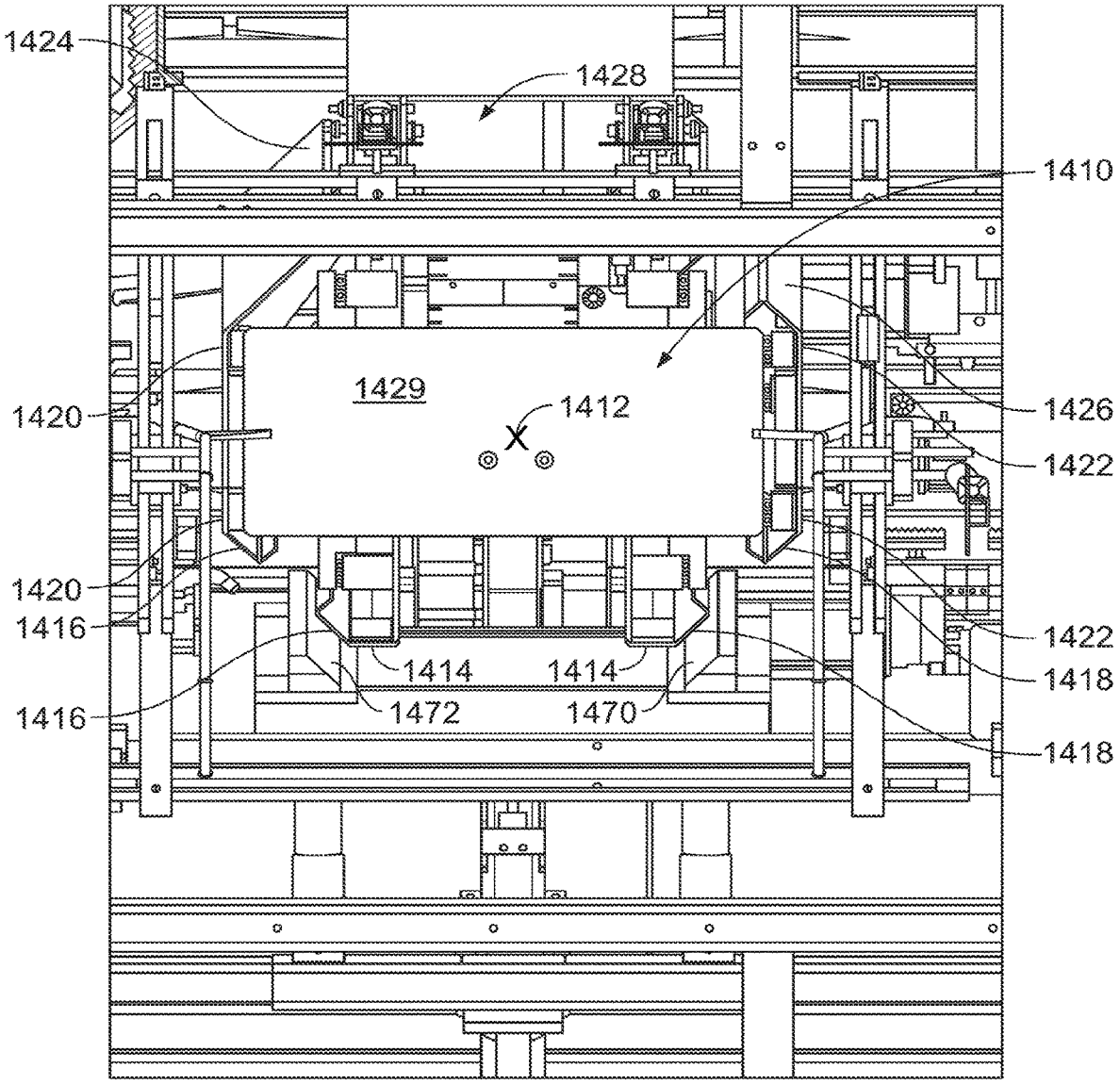
FIG. 8 is a perspective view of a mandrel of the blank folding section shown in FIG. 7.

FIG. 8 illustrates a perspective view of the mandrel 1410 of the blank folding section 1400 (shown in FIG. 7). The mandrel 1410 includes a central longitudinal axis 1412, a plurality of side walls 1414, 1416, 1418, 1420, 1422, 1424, 1426, 1428, and a retractable ejector plate 1429. In the exemplary embodiment, the eight side walls 1414, 1416, 1418, 1420, 1422, 1424, 1426, 1428 may each be defined by a plurality of side wall pieces. At least one entire side wall 1414, 1416, 1418, 1420, 1422, 1424, 1426, 1428 is movable towards the central longitudinal axis 1412 of the mandrel 1410. The movable side may be moveable by any mechanism, structure, and/or means that facilitates decreasing an outer periphery of the mandrel 1410 for facilitating the ejection of erected barrel 200, which will be described in greater detail later.

The ejector plate 1429 is movable along the central longitudinal axis 1412 of the mandrel 1410 so that the ejector plate 1429 may be used as a support surface to facilitate folding the bottom of the barrel 200, compressing an adhesive, and ejecting the erected corrugated barrel 200. In a fully extended position, the ejector plate 1429 is positioned downstream of the mandrel 1410 and the bottom flaps 48, 60, 154, 168. In a fully retracted position, the ejector plate 1429 is positioned at least partially between the mandrel 1410 and the bottom flaps 48, 60, 154, 168 so that the ejector plate 1429 applies a force on the interior surfaces the bottom flaps 48, 60, 154, 168 to eject an erected barrel 200 from the mandrel 1410. More specifically, the ejector plate 1429 is movable along the central longitudinal axis 1412 in a direction away from the mandrel 1410 to eject the erected barrel 200 from the machine 1000.

Figure 9:
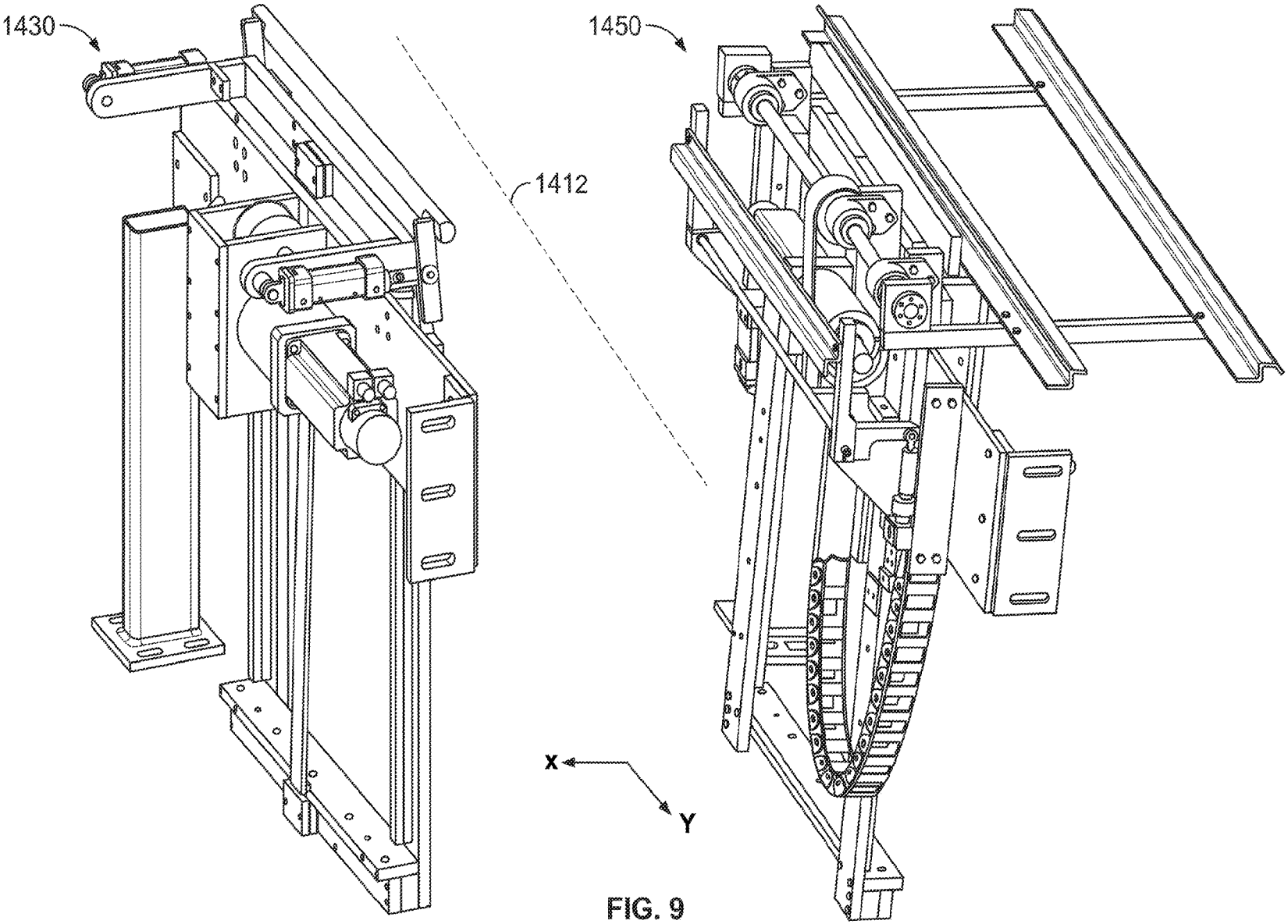
FIG. 9 is a perspective view of a servo lifting assembly of the blank folding section shown in FIG. 7.

FIG. 9 illustrates a perspective view of the servo lifting assembly of the blank folding section 1400 (shown in FIG. 7). The servo lifting assembly facilitates wrapping of the blank 20 tight against the mandrel 1410. As shown in FIG. 9, the servo lifting assembly includes the lateral presser assembly 1430 and the folding arm assembly 1450 positioned on opposite sides of the central longitudinal axis 1412 of the mandrel 1410, as view from the sheet transfer direction Y. The lateral presser assembly 1430 and the folding arm assembly 1450 are described in detail below with reference to FIGS. 10 and 11.

Figure 10:
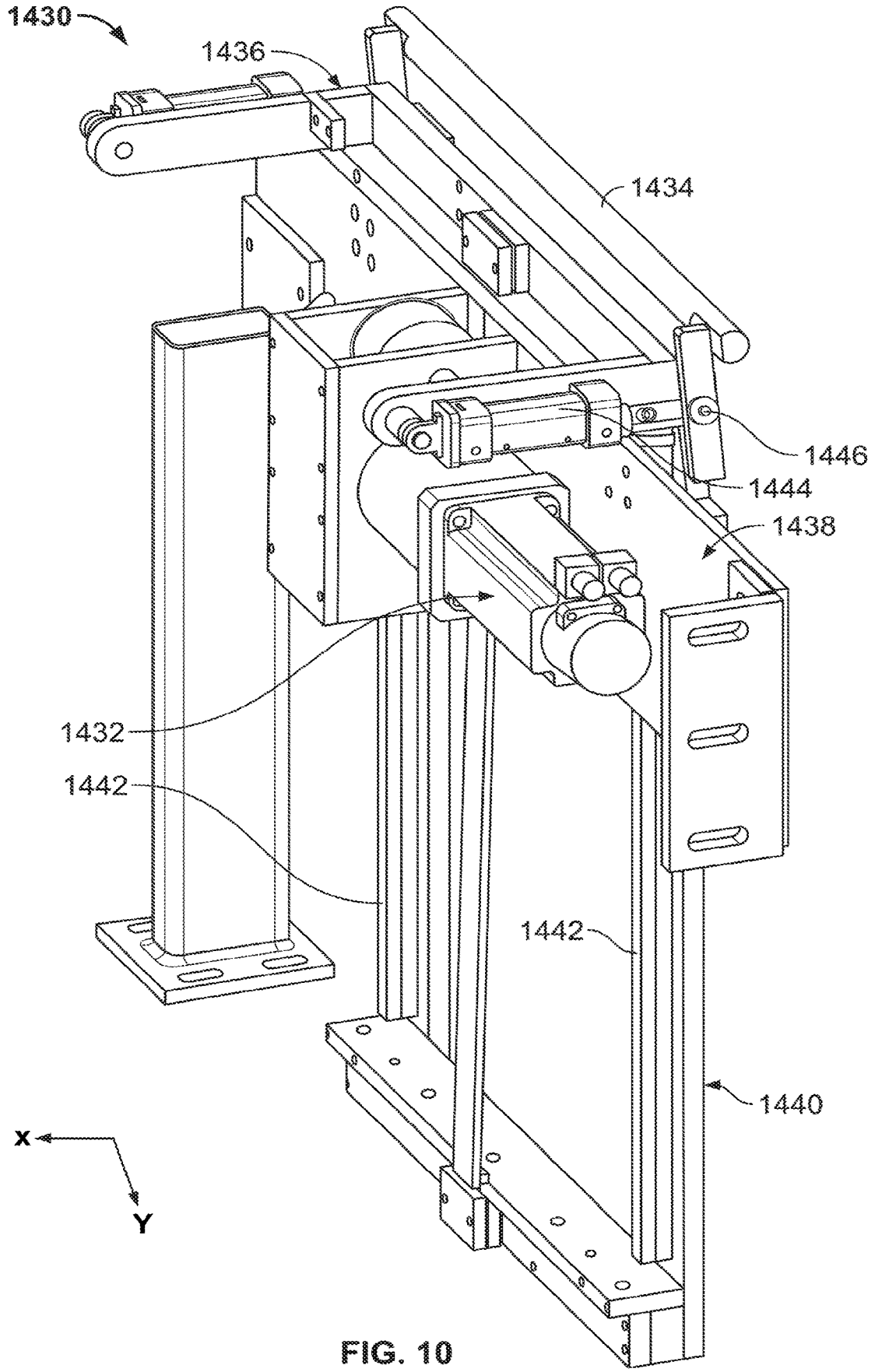
FIG. 10 is a perspective view of a lateral presser assembly of the servo lifting assembly shown in FIG. 9.

FIG. 10 illustrates a perspective view of the lateral presser assembly 1430 of the servo lifting assembly (shown in FIG. 9). In the exemplary embodiment, the lateral presser assembly 1430 includes a servo motor 1432, a engaging bar 1434, an engaging frame 1436, a horizontal fixed frame 1438, a vertical fixed frame 1440, guide rails 1442, an actuator 1444, and a pivot mechanism 1446. The servo motor 1432, the engaging bar 1434, the actuator 1444, and the pivot mechanism 1446 are coupled to the engaging frame 1436, which is slidably coupled to the vertical fixed frame 1440 via the guide rails 1442. The horizontal fixed frame 1438 couples the vertical fixed frame 1440 to the body frame 1402 of the folding section 1400.

During operation, the servo motor 1432 lifts the engaging frame 1436 so that the engaging bar 1434 engages the second side panel 34 (shown in FIG. 1) to fold the panel along fold line 46 and to partially wrap the panel tight against the mandrel 1410. The servo motor 1432 lifts the engaging bar to an upper position, and rotates the engaging bar 1434 about the pivot mechanism 1446 toward the mandrel 1410 so that the engaging bar 1434 engages the second end panel 128 (shown in FIG. 1). As a result, the second side panel 34 and the second end panel 128 are folded along the fold line 136 to wrap the panels tight against the mandrel 1410.

As a result of using the servo motor 1432, components of the lateral presser assembly 1430 may be angularly positioned to facilitate controlling the lateral presser assembly 1430 to tightly wrap the blank 20 tight against the mandrel 1410. Therefore, the servo motor 1432 facilitate erecting corrugated barrels 200 with increased uniformity and efficiency.

Figure 11:
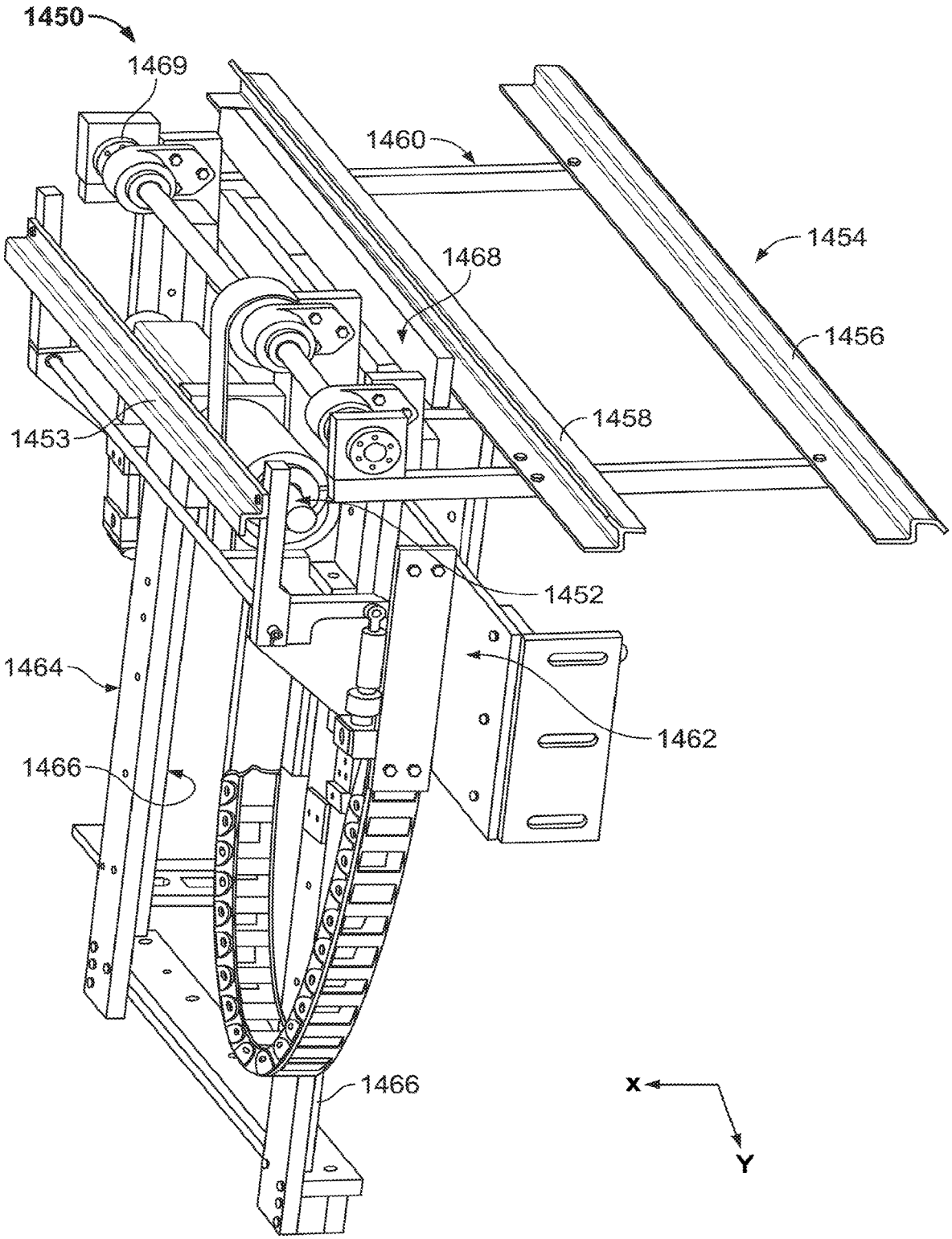
FIG. 11 is a perspective view of a folding arm assembly of the servo lifting assembly shown in FIG. 9.

FIG. 11 illustrates a perspective view of the folding arm assembly 1450 of the servo lifting assembly (shown in FIG. 9). In the exemplary embodiment, the folding arm assembly 1450 includes a servo motor 1452, an engaging bar 1453, a folding arm 1454, a rotating support frame 1460, a horizontal fixed frame 1462, a vertical fixed frame 1464, guide rails 1466, a rotating mechanism 1468, and a pivot 1469. The folding arm 1454 includes substantially parallel arm portions 1456, 1458 supported by the support frame 1460. The servo motor 1452, the engaging bar 1453, the folding arm 1454, and the rotating mechanism 1468 are coupled to the support frame 1460, which is slidably coupled to the vertical fixed frame 1464 via the guide rails 1466. The horizontal fixed frame 1462 couples the vertical fixed frame 1464 to the body frame 1402 of the folding section 1400.

During operation, a servo motor (not shown) lifts the engaging bar 1453, the folding arm 1454, the support frame 1460, and the rotating mechanism 1468 to an upper position. More specifically, the servo motor (not shown) lifts the engaging bar 1453 so that the engaging bar 1453 engages the first side panel 26 to fold the panel along the fold line 40 and to wrap the panel tight against the mandrel 1410. The servo motor 1452 lifts and rotates the folding arm 1454 using the rotating mechanism 1468 so that the folding arm 1454 rotates about the pivot 1469 toward the mandrel 1410 so that the arm portions 1456, 1458 engage the front panel 22. As a result, the first angled front-side panel 24 is folded along the fold lines 36, 38 and the front panel 22 is folded along the fold line 36 to wrap the first angled front-side panel 24 and the front panel 22 tight against the mandrel 1410.

As a result of using the servo motor 1452, components of the folding arm assembly 1450 may be angularly positioned to facilitate controlling the folding arm assembly 1450 to tightly wrap the blank 20 tight against the mandrel 1410. Therefore, the servo motor 1452 facilitate erecting corrugated barrels 200 with increased uniformity and efficiency.

Figure 12:
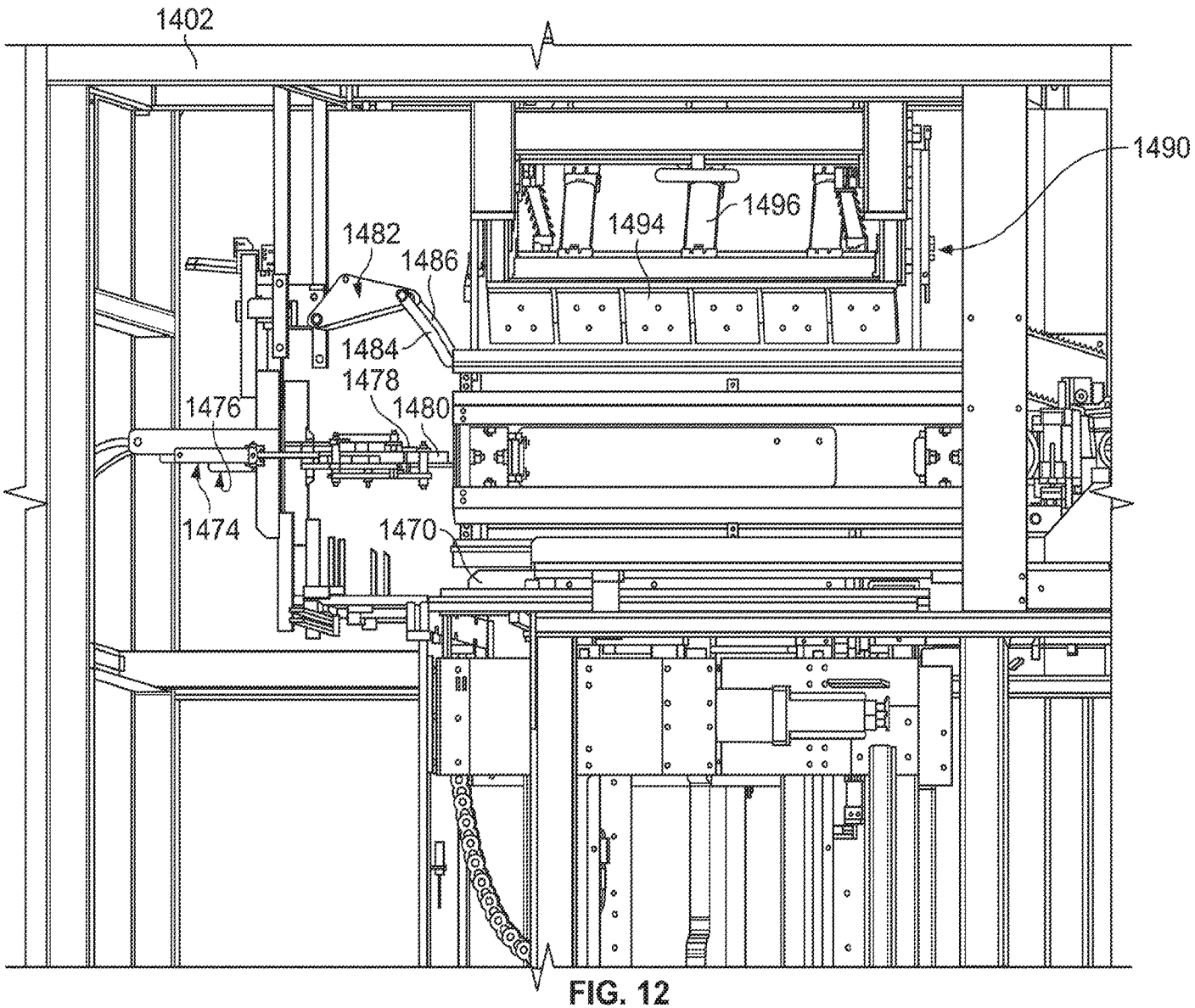
FIG. 12 is a front perspective view of flap folder assemblies of the blank folding section shown in FIG. 7.
Figure 13:
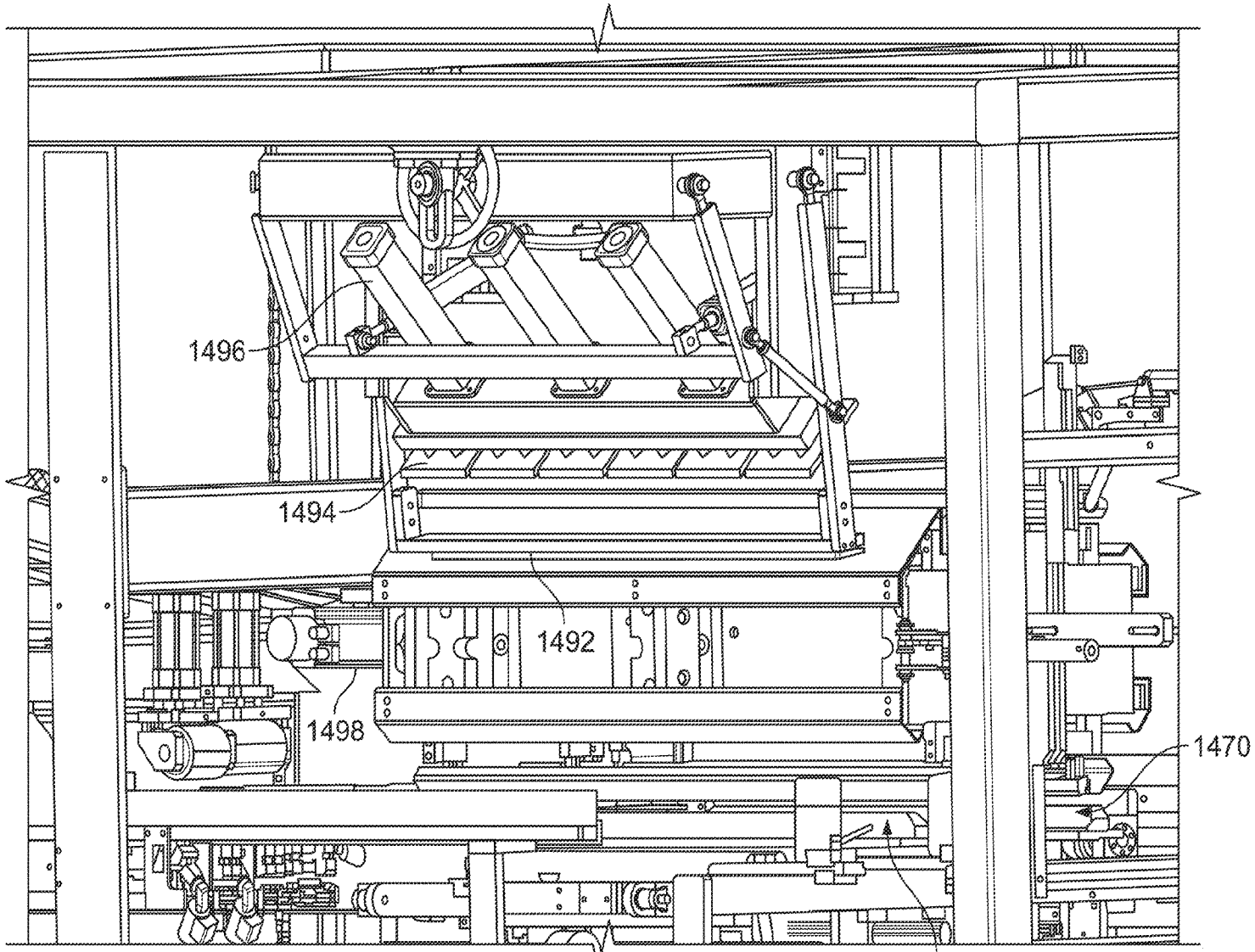
FIG. 13 is a rear perspective view of flap folder assemblies of the blank folding section shown in FIG. 7.

FIG. 12 illustrates a front perspective view of flap folder assemblies of the blank folding section 1400 (shown in FIG. 7). FIG. 13 illustrates a back perspective view of the flap folder assemblies of the blank folding section 1400 (shown in FIG. 7). In the exemplary embodiment, the servo controlled flap folder assemblies include retractable miter bars 1470, 1472 (also shown in FIG. 8), retractable side flap finger mechanisms 1474, 1476, a retractable bottom back flap plate (not shown), a retractable bottom front flap finger assembly 1482, and a retractable end panel presser assembly 1490. The retractable side flap finger mechanisms 1474, 1476 include retractable fingers 1478, 1480, respectively. The retractable bottom front flap finger assembly 1482 includes retractable fingers 1484, 1486. The retractable end panel presser assembly 1490 includes an end panel folder assembly 1492, a retractable end panel presser 1494, and an actuating mechanism 1496.

Prior to engagement of the blank 20 by the lateral presser assembly 1430 and the folding arm assembly 1450, the retractable miter bars 1470, 1472 press the first angled back-side panel 28 (shown in FIG. 1) and the second angled back-side panel 32 (shown in FIG. 1) inward towards the central longitudinal axis 1412 of the mandrel 1410. Therefore, the back panel 30 (shown in FIG. 1) is folded along the fold lines 42, 44 (shown in FIG. 1) and wrapped tight against the mandrel. Moreover, the first angled back-side panel 28 and the second angled back-side panel 32 are folded along the fold lines 42, 44, respectively, and partially wrapped tight against the mandrel 1410.

During engagement of the blank 20 (shown in FIG. 1) by the lateral presser assembly 1430 and the folding arm assembly 1450, the ejector plate 1429 of the mandrel 1410 is in a retracted position. After the front panel 22 (shown in FIG. 1) and the second side panel 34 are wrapped tight against the mandrel 1410, the retractable side flap finger mechanisms 1474, 1476 manipulate the retractable fingers 1478, 1480, respectively, to fold the bottom first and second side flaps 154, 168 along the fold lines 156, 170, respectively (all shown in FIG. 1), and inward towards the central longitudinal axis 1412 of the mandrel 1410 to wrap the bottom first and second side flaps 154, 168 tight against the mandrel 1410. The retractable bottom front flap finger assembly 1482 manipulates the retractable fingers 1484, 1486 to fold the bottom front flap 48 along the fold line 56, inward towards the central longitudinal axis 1412, and over the bottom first and second side flaps 154 and 168 to wrap the bottom front flap 48 tight against the mandrel 1410. The retractable bottom back flap plate (not shown) rotates inward and downward towards the central longitudinal axis 1412 to fold the bottom back flap 60 along the fold line 68 to wrap the bottom back flap 60 tight against the mandrel 1410 with the bottom front flap 48 positioned therebetween.

After the second end panel 128 is folded against the mandrel 1410, the retractable end panel presser assembly 1490 rotates the end panel folder assembly 1492 inward towards the central longitudinal axis 1412 to fold the first end panel 126 along the fold line 134 and over the exterior surface of the folded second end panel 128. The retractable end panel presser 1494 is actuated by the actuating mechanism 1496 inward and downward towards the central longitudinal axis 1412 and over the first and second end panels 126, 128 to seal and form a manufacturer's joint. The erected corrugated barrel 200 can then be ejected from the machine 1000 (shown in FIG. 5). The corrugated barrel 200 is considered an erected barrel that may be closed by folding the top flaps 50, 62, 138, 140, 142, 144, 158, 172, e.g., after filling the barrel 200 with a substance.

As a result of using servo motors (not shown), components of the flap folder assemblies including the retractable miter bars 1470, 1472 (also shown in FIG. 8), retractable side flap finger mechanisms 1474, 1476, retractable bottom back flap plate (not shown), retractable bottom front flap finger assembly 1482, and retractable end panel presser assembly 1490 may be angularly positioned to facilitate controlling the respective flap folder assembly to tightly wrap the blank 20 tight against the mandrel 1410. Therefore, the servo motors facilitate erecting corrugated barrels 200 with increased uniformity and efficiency.

During ejection of the erected corrugated barrel 200, an entire side 1414, 1416, 1418, 1420, 1422, 1424, 1426, 1428 is movable towards the central longitudinal axis 1412 of the mandrel 1410 to change an outer periphery of the mandrel to facilitate reducing a size of the mandrel 1410. Therefore, the smaller collapsed mandrel 1410 is part of an ejection assembly that facilitates reducing friction forces that may exist between the erected corrugated barrel 200 and the larger mandrel 1410 during ejection of the erected corrugated barrel 200.

The ejection assembly also includes the retractable ejector plate 1429 movable from a fully retracted position to a fully extended position by moving the ejector plate 1429 in the sheet transfer direction Y along the central longitudinal axis 1412 of the mandrel 1410. The eject servo 1498 facilitates driving and controlling movement of the ejector plate 1429. Specifically, the eject servo 1498 may facilitate controlling a speed and a position of the ejector plate 1429 more accurately and faster than without the eject servo 1498. In the exemplary embodiment, the eject servo 1498 includes an electric motor that includes an output shaft for driving rotation of a conveyor coupled to the ejector plate 1429. As a result, the ejector plate 1429 pushes a bottom of the erected corrugated barrel 200 away from the mandrel 1410 to the outfeed section 1500. The outfeed section 1500 include a plurality of conveyors and a tipper to transition the erected corrugated barrel 200 from a horizontal to an upright orientation (shown in FIGS. 2-5).

As a result of using the eject servo 1498, components of the ejector assembly may be angularly positioned to facilitate controlling the ejector assembly to eject the erected corrugated blank 20 from the mandrel 1410 and the machine 1400. Therefore, the eject servo 1498 facilitates reducing friction forces during ejection of the erected corrugated barrels 200 and facilitates speedy ejection of the erected corrugated barrels 200.

Figure 14:
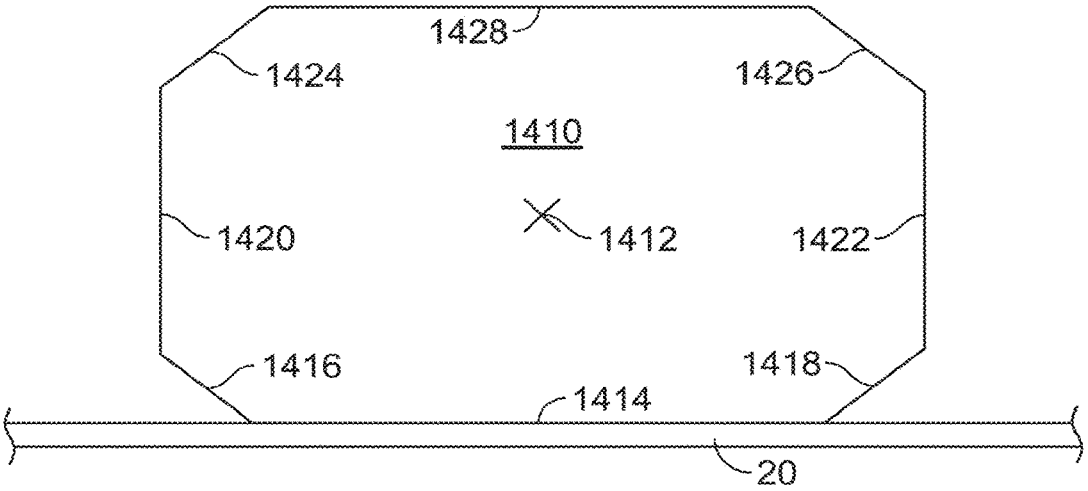
FIG. 14 is schematic cross-sectional view of the mandrel shown in FIG. 8 illustrating the blank shown in FIG. 1 in a partially wrapped state.
Figure 15:
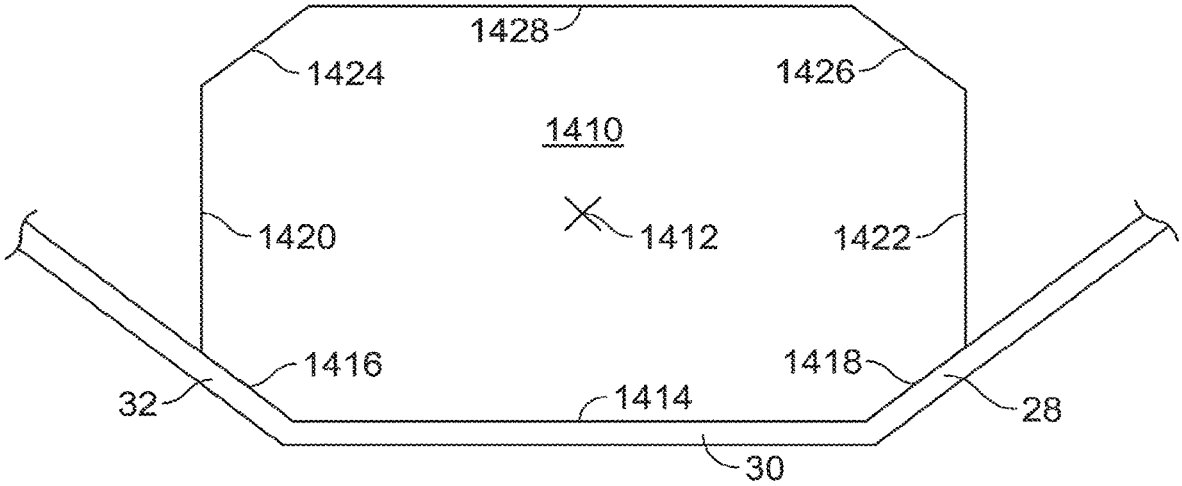
FIG. 15 is schematic cross-sectional view of the mandrel shown in FIG. 14 illustrating the blank shown in FIG. 1 in another partially wrapped state.

FIGS. 14-19 illustrate schematic cross-sectional views of the mandrel 1410 (shown in FIG. 8) illustrating the blank 20 (shown in FIG. 1) in a partially wrapped states. As shown in FIG. 14, the blank 20 is positioned underneath the mandrel 1410. As shown in FIG. 15, after the miter bars 1470, 1472 move in towards the central longitudinal axis 1412, the miter bars 1470, 1472 engage the blank 20 so that the back panel 30 is wrapped tight against the mandrel side 1414, and the first angled back-side panel 28 and the second angled back-side panel 32 are partially wrapped tight against the mandrel side walls 1416, 1418.

Figure 16:
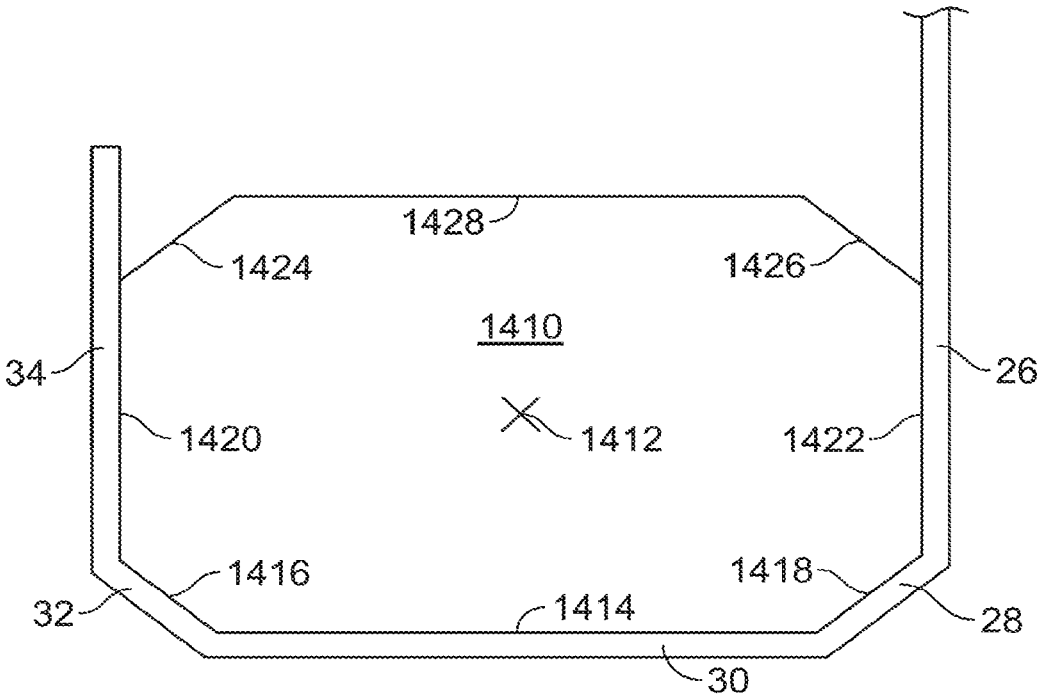
FIG. 16 is schematic cross-sectional view of the mandrel shown in FIG. 15 illustrating the blank shown in FIG. 1 in another partially wrapped state.

As shown in FIG. 16, after movement of the lateral presser assembly 1430 and the folding arm assembly 1450, the lateral presser assembly 1430 and the folding arm assembly 1450 engage the blank 20 so that the first and second side panels 26, 34 are wrapped tight against the mandrel side walls 1420, 1422, respectively, and the first angled back-side panel 28 and the second angled back-side panel 32 are fully wrapped tight against the mandrel side walls 1416, 1418.

Figure 17:
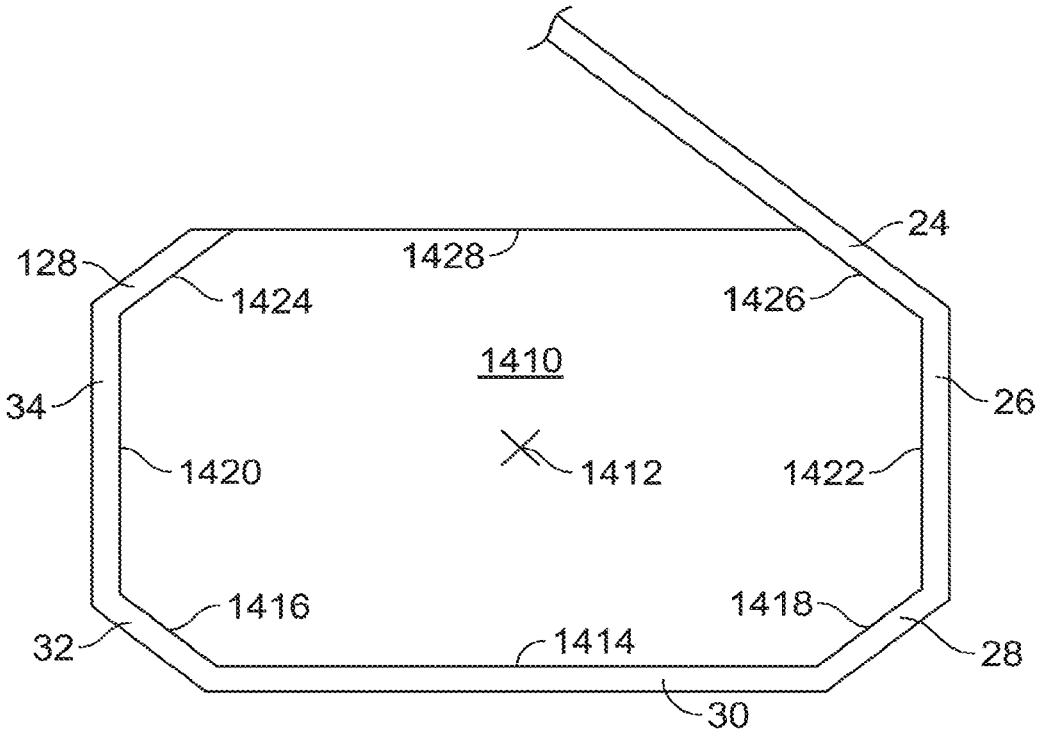
FIG. 17 is schematic cross-sectional view of the mandrel shown in FIG. 16 illustrating the blank shown in FIG. 1 in another partially wrapped state.

As shown in FIG. 17, after further movement of the lateral presser assembly 1430 and the folding arm assembly 1450, the lateral presser assembly 1430 and the folding arm assembly 1450 engage the blank 20 so that the second end panel 128 and the first angled front-side panel 24 are wrapped tight against the mandrel side walls 1424, 1426, respectively.

Figure 18:
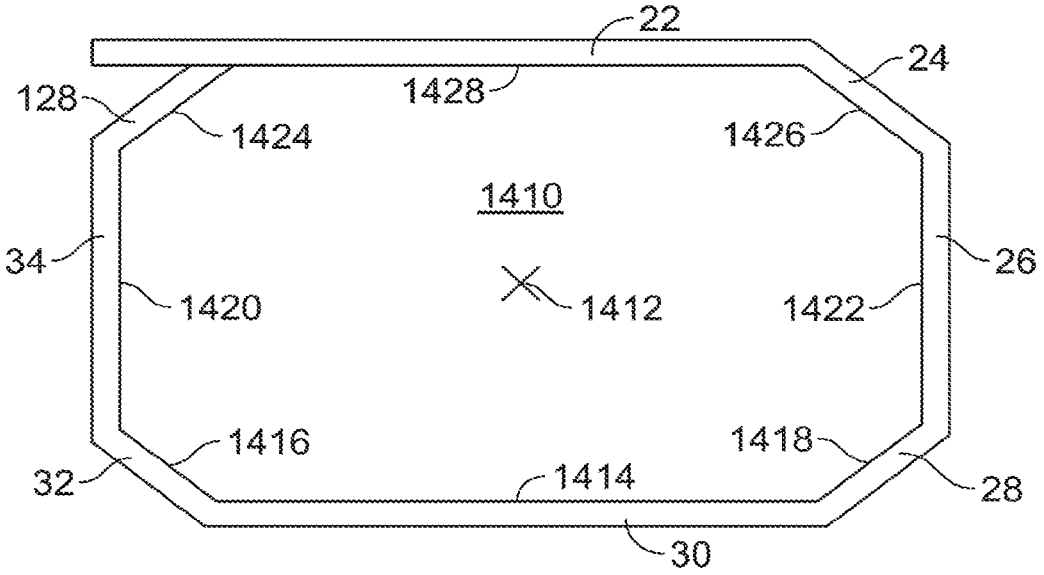
FIG. 18 is schematic cross-sectional view of the mandrel shown in FIG. 17 illustrating the blank shown in FIG. 1 in another partially wrapped state.

As shown in FIG. 18, after further movement of the lateral presser assembly 1430 and the folding arm assembly 1450, the lateral presser assembly 1430 and the folding arm assembly 1450 engage the blank 20 so that the front panel 22 is wrapped tight against the mandrel side wall 1428.

Figure 19:
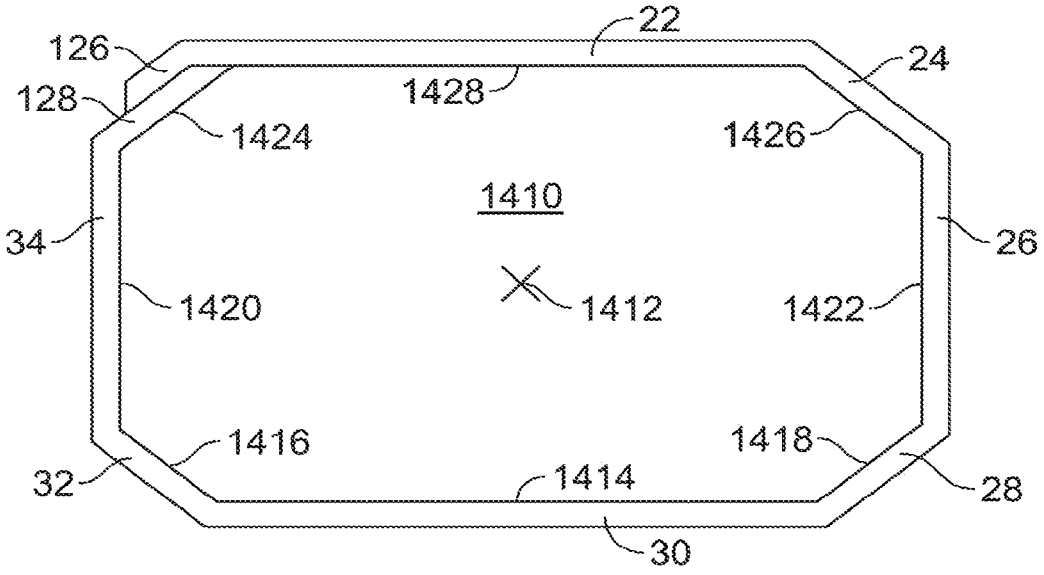
FIG. 19 is schematic cross-sectional view of the mandrel shown in FIG. 18 illustrating the blank shown in FIG. 1 in another partially wrapped state.

As shown in FIG. 19, after further movement of the lateral presser assembly 1430 and the folding arm assembly 1450, the lateral presser assembly 1430 and the folding arm assembly 1450 engage the blank 20 so that the first end panel 126 is partially wrapped over the exterior surface of the second end panel 128 and tight against the mandrel side 1424.

Although the blank 20 has been described as wrapping tight against the mandrel 1410 in the exemplary order described above, it should be appreciated that the blank 20 may engage side walls of the mandrel 1410 in any order that allows the first and second end panels 126 to overlap to facilitate forming the manufacturer's joint. However, it should also be appreciated that an interior surface of the second panel 128 may overlap an exterior surface of the first end panel 126 to facilitate forming the manufacturer's joint within the scope of the present invention.

As a result of using servo motors, components of the lateral presser assembly 1430, the folding arm assembly 1450, the retractable side flap finger mechanisms 1474, 1476, and the retractable bottom front flap finger assembly 1482 may be angularly positioned to facilitate controlling the respective folding assemblies to tightly wrap the blank 20 tight against the mandrel 1410. Therefore, the servo motors facilitate erecting corrugated barrels 200 with increased uniformity and efficiency.

While the invention has been described in terms of various specific embodiments, those skilled in the art will recognize that the invention can be practiced with modification within the spirit and scope of the claims.

The invention claimed is:

1. A machine for forming a container from a blank of sheet material, said machine comprising: an outer body frame; a mandrel mounted to the body frame and having an external shape complimentary to at least a portion of the container, the mandrel comprising a central longitudinal axis and a plurality of side faces, wherein the blank includes a plurality of side panels, the blank positionable beneath the mandrel; a lifting assembly coupled to the body frame; a lateral presser assembly and a folding arm assembly coupled to the lifting assembly, wherein the lifting assembly moves the lateral presser assembly and the folding arm assembly in a first direction and an opposite, second direction perpendicular to the longitudinal axis of the mandrel; and a folding arm servomechanism operatively connected to a folding arm of the folding arm assembly, the folding arm rotatably mounted, wherein the folding arm servomechanism electrically controls at least one of a speed and a timing of rotational movement of the folding arm independently of a speed and a timing of movement of the lifting assembly, the folding arm servomechanism rotating the folding arm relative to the mandrel to wrap a first portion of the blank around the mandrel; and a lateral presser servomechanism operatively connected to an engaging bar of the lateral presser assembly, the engaging bar rotatably mounted, wherein the lateral presser servomechanism electrically controls at least one of a speed and a timing of rotational movement of the engaging bar independently of the speed and the timing of movement of the lifting assembly, the lateral presser servomechanism rotating the engaging bar relative to the mandrel to wrap a second portion of the blank around the mandrel to at least partially form the container.

2. The machine according to claim 1, further comprising a grip servomechanism and a gripping mechanism mounted to the body frame that grips and transfers the blank from an elevator section to a transfer section, the grip servomechanism operatively connected to the gripping mechanism and electrically controlling the speed and position of at least a portion of the gripping mechanism.

3. The machine according to claim 2, further comprising a transfer servomechanism and a transfer assembly that transfers the blank to the lifting assembly, the transfer servomechanism operatively connected to the transfer assembly and electrically controlling a speed and a position of at least a portion of the transfer assembly.

4. The machine according to claim 1, further comprising a pair of retractable miter bars that are positioned on opposing sides of the mandrel, wherein a miter servomechanism is operatively connected to the miter bars and electrically controls a speed and a position of the miter bars, and wherein the miter servomechanism moves the miter bars towards and away from the mandrel, and the miter bars press at least a portion of the blank against the mandrel.

5. The machine according to claim 1, wherein the folding arm assembly comprises an engaging bar, wherein the engaging bar presses the first portion of the blank against the mandrel when the lifting assembly moves towards the mandrel.

6. The machine according to claim 1, wherein the lateral presser assembly further comprises a pivot mechanism.

7. The machine according to claim 1, further comprising a pair of retractable side flap finger mechanisms that are positioned on opposing sides of the mandrel, wherein a seventh servomechanism is operatively connected to the side flap finger mechanisms and electrically controls a speed and a position of the side flap finger mechanisms, wherein the seventh servomechanism moves the side flap finger mechanisms towards and away from the mandrel, and the side flap finger mechanisms press at least a portion of the blank against the mandrel.

8. The machine according to claim 1, further comprising a pair of retractable bottom front flap finger mechanisms that are positioned on opposing sides of the mandrel, wherein an eighth servomechanism is operatively connected to the bottom front flap finger mechanisms and electrically controls a speed and a position of the bottom front flap finger mechanisms, wherein the eighth servomechanism moves the bottom front flap finger mechanisms towards and away from the mandrel, and the bottom front flap finger mechanisms press at least a portion of the blank against the mandrel.

9. The machine according to claim 1, further comprising a retractable bottom back flap plate that is positioned adjacent to the mandrel, wherein a ninth servomechanism is operatively connected to the bottom back flap plate and electrically controls a speed and a position of the bottom back flap plate, wherein the ninth servomechanism moves the bottom back flap plate towards and away from the mandrel, and the bottom back flap plate presses at least a portion of the blank against the mandrel.

10. The machine according to claim 1, further comprising a retractable end panel presser assembly that is positioned adjacent to the mandrel, wherein a tenth servomechanism is operatively connected to the end panel presser assembly and electrically controls a speed and a position of the end panel presser assembly, wherein the retractable end panel presser assembly comprises a retractable end panel presser and an actuating mechanism, wherein the tenth servomechanism moves the end panel presser towards and away from the mandrel, and the end panel presser presses at least a portion of the blank against the mandrel.

* * * * *